US012714914B2

(12) United States Patent
Kim et al.

(10) Patent No.: US 12,714,914 B2
(45) Date of Patent: Aug. 25, 2026

(54) WEARABLE DEVICE AND EXERCISE ASSISTANCE METHOD BY THE SAME

(71) Applicant: Samsung Electronics Co., Ltd., Suwon-si (KR)

(72) Inventors: Sanghun Kim, Suwon-si (KR); Joonyoung Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 140 days.

(21) Appl. No.: 18/748,221

(22) Filed: Jun. 20, 2024

(65) Prior Publication Data

US 2025/0032853 A1 Jan. 30, 2025

Related U.S. Application Data

(63) Continuation of application No. PCT/KR2024/006953, filed on May 23, 2024.

(30) Foreign Application Priority Data

Jul. 24, 2023 (KR) ..... 10-2023-0095890
Oct. 5, 2023 (KR) ..... 10-2023-0132557

(51) Int. Cl.
*A63B 24/00* (2006.01)

(52) U.S. Cl.
CPC .... *A63B 24/0062* (2013.01); *A63B 2220/803* (2013.01); *A63B 2220/836* (2013.01)

(58) Field of Classification Search
CPC ..... A63B 21/00181; A63B 21/00196; A63B 21/0058; A63B 21/0059; A63B 21/0552;
(Continued)

(56) References Cited

U.S. PATENT DOCUMENTS 5,409,435 A * 4/1995 Daniels ..... F16D 57/002 482/901
6,280,361 B1 * 8/2001 Harvey ..... A63B 24/00 482/4

(Continued)

FOREIGN PATENT DOCUMENTS

CN 110900638 A 3/2020
CN 108500957 B * 3/2021 ..... A61B 5/22

(Continued)

OTHER PUBLICATIONS

International Search Report dated Aug. 27, 2024 for PCT Application No. PCT/KR2024/006953.

(Continued)

*Primary Examiner* — Gary D Urbiel Goldner
(74) *Attorney, Agent, or Firm* — Nixon & Vanderhye P.C.

(57) ABSTRACT

A wearable device may include an actuator including a motor and/or circuitry, a sensor configured to generate motion data corresponding to a motion of a hand of a user, at least one processor configured to control the actuator, a cable connected to the actuator, and a body coupling component connected to the cable and connected or fixed to a body part of the user, wherein the processor is individually and/or collectively configured to estimate a position of the hand of the user based on the motion data corresponding to the motion of the hand of the user, determine a tension value to be applied to the cable at the position of the hand of the user based on the position of the hand of the user and a tension control model defined with respect to a surrounding space of the user, and control the actuator to generate tension at the determined tension value on the cable.

20 Claims, 18 Drawing Sheets

(58) Field of Classification Search
CPC ..... A63B 21/153; A63B 21/4005; A63B 21/4007; A63B 21/4011; A63B 21/4017; A63B 21/4021; A63B 24/0062; A63B 24/0087; A63B 2024/0093; A63B 2024/0096; A63B 71/0622; A63B 2071/0625; A63B 2071/0627; A63B 2071/063; A63B 2071/0636; A63B 2071/065; A63B 2071/0655; A63B 2071/0663; A63B 2071/0666; A63B 2071/0677; A63B 2071/068; A63B 2214/00; A63B 2220/10; A63B 2220/30; A63B 2220/40; A63B 2220/51; A63B 2220/72; A63B 2220/803; A63B 2220/805; A63B 2220/806; A63B 2220/807; A63B 2220/808; A63B 2220/836; A63B 2225/50; A63B 2225/74; A63B 2230/062
See application file for complete search history.

(56) References Cited

U.S. PATENT DOCUMENTS

| | | | | |
|---|---|---|---|---|
| 9,351,900 | B2 * | 5/2016 | Walsh | A61F 2/68 |
| 12,151,134 | B2 * | 11/2024 | Park | A63B 21/00043 |
| 12,194,624 | B2 * | 1/2025 | Li | B25J 9/0006 |
| 2007/0004570 | A1 | 1/2007 | Afanasenko et al. | |
| 2008/0119763 | A1 * | 5/2008 | Wiener | A61B 5/224 600/587 |
| 2017/0020765 | A1 | 1/2017 | Lim et al. | |
| 2017/0274249 | A1 * | 9/2017 | Moebius | A63B 23/0405 |
| 2019/0022452 | A1 * | 1/2019 | Tedesco | A63B 21/154 |
| 2019/0117493 | A1 * | 4/2019 | Murakami | A61B 5/6807 |
| 2019/0125610 | A1 * | 5/2019 | Murakami | A61H 3/008 |
| 2020/0155891 | A1 * | 5/2020 | Tedesco | A63B 21/4025 |
| 2021/0001170 | A1 * | 1/2021 | Fung | A63B 22/0046 |
| 2021/0387327 | A1 | 12/2021 | Kornbluh et al. | |
| 2021/0402255 | A1 * | 12/2021 | Fung | A63B 69/0064 |
| 2023/0125536 | A1 * | 4/2023 | Koifman | A63B 71/0622 482/5 |
| 2024/0115898 | A1 * | 4/2024 | Kim | A63B 21/4043 |
| 2024/0149102 | A1 * | 5/2024 | Park | A63B 24/0062 |
| 2024/0416176 | A1 * | 12/2024 | Jung | A63B 21/4021 |
| 2025/0025748 | A1 * | 1/2025 | Maybin | A63B 24/0062 |

FOREIGN PATENT DOCUMENTS

| | | | | |
|---|---|---|---|---|
| JP | 2019-081247 | A | 5/2019 | |
| KR | 10-2015-0077413 | A | 7/2015 | |
| KR | 10-2019-0012986 | A | 2/2019 | |
| KR | 20200060244 | A | 5/2020 | |
| KR | 20200122343 | A | 10/2020 | |
| KR | 10-2022-0096281 | A | 7/2022 | |
| KR | 20230101685 | A | 7/2023 | |
| KR | 20240030909 | A * | 3/2024 | A63B 21/4001 |

OTHER PUBLICATIONS

Yun et al., "Body-powered variable impedance: An approach to augmenting humans with a passive device by reshaping lifting posture", Science Robotics, Research Article, 6, eabe1243, pp. 1-9, Aug. 25, 2021.

* cited by examiner

WEARABLE DEVICE AND EXERCISE ASSISTANCE METHOD BY THE SAME

CROSS-REFERENCE TO RELATED APPLICATIONS

This application is a continuation of International Application No. PCT/KR2024/006953, filed on May 23, 2024, in the Korean Intellectual Property Receiving Office, and claiming priority to Korean Patent Application No. 10-2023-0095890, filed on Jul. 24, 2023, and Korean Patent Application No. 10-2023-0132557, filed on Oct. 5, 2023, in the Korean Intellectual Property Office, the disclosures of each of which are incorporated by reference herein in their entireties.

BACKGROUND

1. Field

Certain example embodiments relate to a wearable device and/or an exercise assistance method by the same.

2. Description of Related Art

A change into aging societies has contributed to a growing number of people who experience inconvenience and pain from reduced muscular strength or joint problems due to aging. Thus, there is a growing interest in assistive devices that assist elderly users or patients with reduced muscular strength or joint problems, or those desiring to exercise, to exercise more conveniently. As the assistive device, a device worn on the waist of the user and assisting walking or leg exercise of the user has been known.

SUMMARY

According to an example embodiment, a wearable device may include an actuator comprising a motor and/or circuitry, a sensor configured to measure a motion of a hand of a user and generate motion data corresponding to the motion of the hand of the user, at least one processor comprising processing circuitry, a cable connected, directly or indirectly, to the actuator, and a body coupling component connected, directly or indirectly, to the cable and connected, directly or indirectly, or fixed to a body part of the user. The at least one processor may be individually and/or collectively configured to estimate a position of the hand of the user based on the motion data corresponding to the motion of the hand of the user, determine a tension value to be applied to the cable at the position of the hand of the user based on the position of the hand of the user and a tension control model defined with respect to a surrounding space of the user, and control the actuator to generate tension at the determined tension value on the cable.

According to an example embodiment, a wearable device may include an actuator, a sensor configured to measure a motion of a leg of a user and generate motion data corresponding to the motion of the leg of the user, at least one processor configured to control the actuator, a cable connected to the actuator, and a body coupling component connected to the cable and connected or fixed to a body part of the user. The at least one processor may be configured to estimate a position of the hand of the leg based on the motion data corresponding to the motion of the leg of the user, determine a tension value to be applied to the cable at the position of the leg based on the position of the leg of the user and a tension control model defined with respect to a surrounding space of the user, and control the actuator to generate tension at the determined tension value on the cable.

According to an example embodiment, an exercise assistance method by a wearable device including an actuator, a sensor, a cable connected to the actuator, and a body coupling component connected to the cable and connected or fixed to a body part of a user, may include obtaining motion data corresponding to a motion of a hand of the user by using the sensor, estimating a position of the hand of the user based on the motion data, determining a tension value to be applied to the cable at the position of the hand of the user based on the position of the hand of the user and a tension control model defined with respect to a surrounding space of the user, and controlling the actuator to generate tension at the determined tension value on the cable.

Figure 1A:
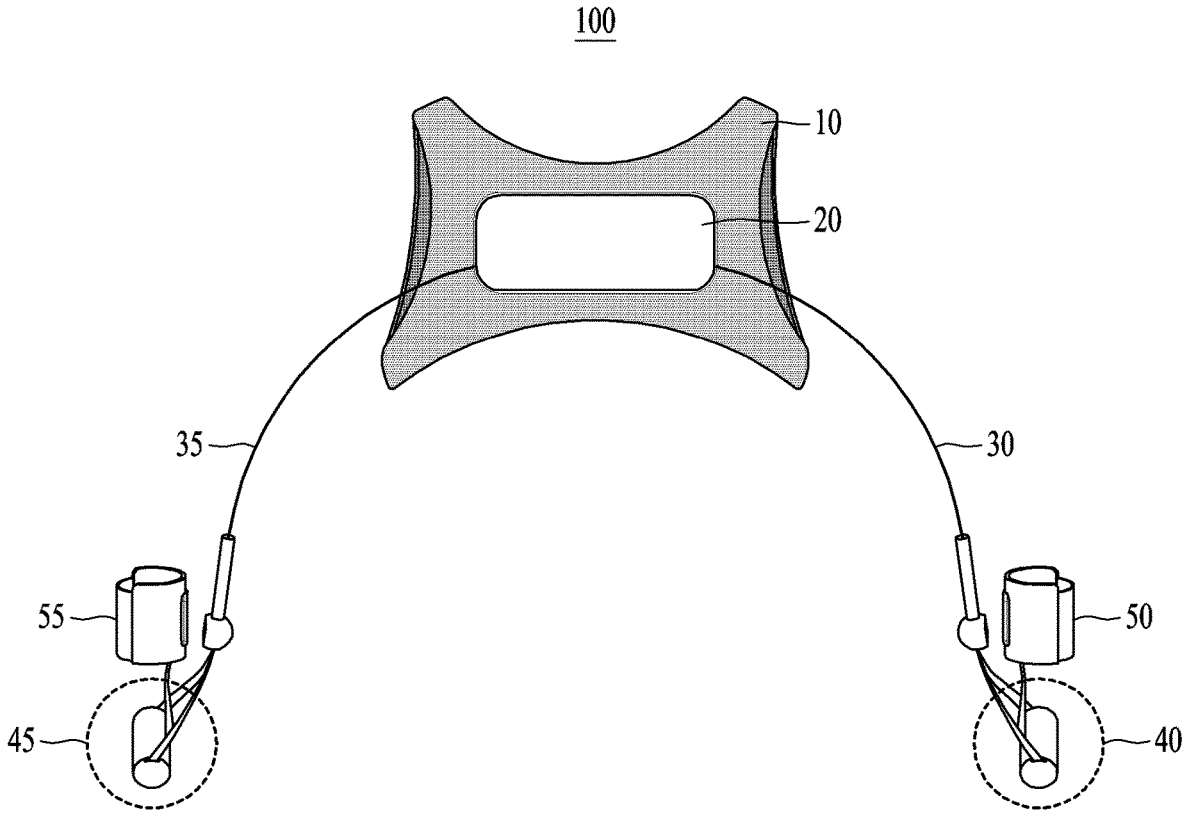
FIGS. 1A and 1B are diagrams illustrating an overview of a wearable device according to an example embodiment.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed structural or functional description is provided as an example only and various alterations and modifications may be made to the examples. Accordingly, the example embodiments are not construed as limited to the disclosure and should be understood to include all changes, equivalents, and replacements within the idea and the technical scope of the disclosure.

As used herein, the singular forms "a", "an", and "the" include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms, including technical and scientific terms, used herein have the same meaning as commonly understood by one of ordinary skill in the art to which this disclosure pertains. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Hereinafter, examples will be described in detail with reference to the accompanying drawings. When describing the embodiments with reference to the accompanying drawings, like reference numerals refer to like elements and a repeated description related thereto will be omitted.

Figure 1B:
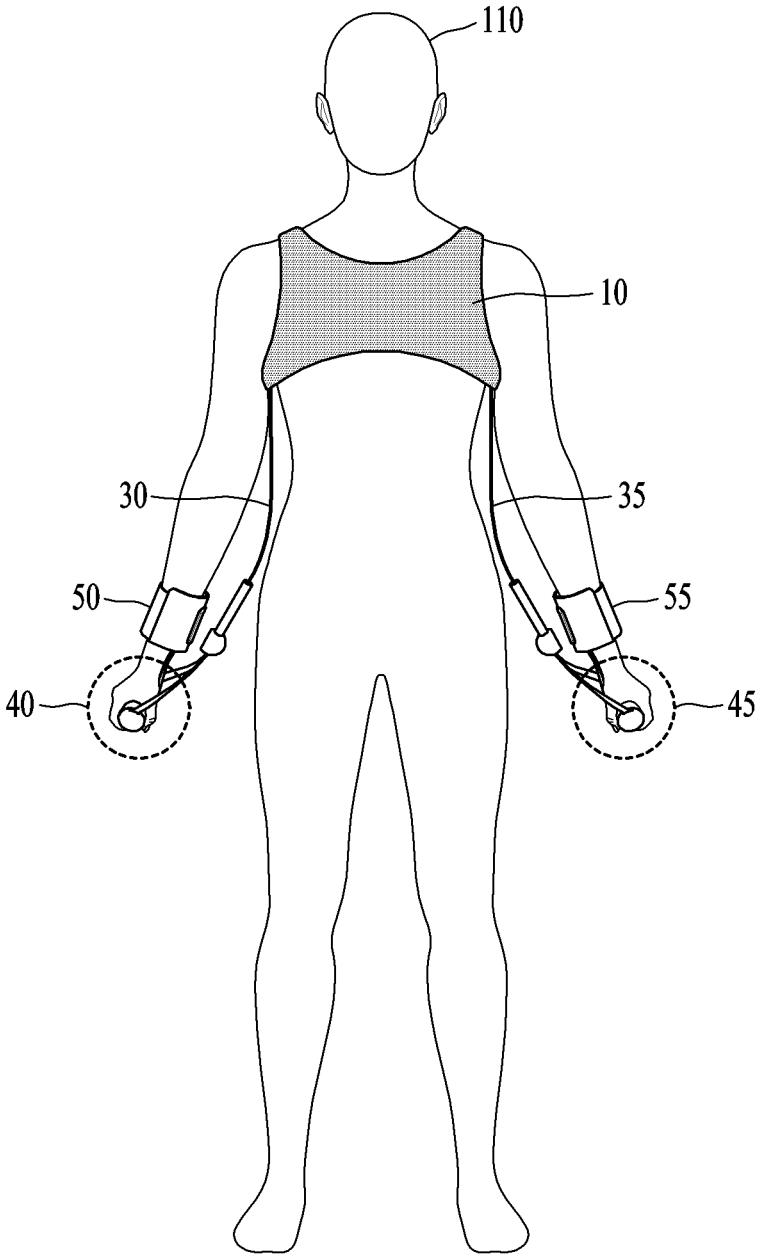

FIGS. 1A and 1B are diagrams illustrating an overview of a wearable device according to an example embodiment.

Referring to FIGS. 1A and 1B, a wearable device 100 may be a device worn on a body of a user 110 to assist the user 110 in exercising and/or rehabilitation. The wearable device 100 may be used to measure a physical ability (e.g., an exercise ability or an exercise posture) of the user 110 or may be used to play content, such as a game. In an example embodiment, the wearable device 100 may be used for muscle training of the user 110, exercise posture guide, and/or an exergame. Herein, the term "wearable device" may be replaced with a "wearable robot", an "exercise assistance device", or a "gaming gear". The wearable device 100 may be worn on a body (e.g., an upper body (a torso, a waist, an arm, a wrist, a hand, etc.) or a lower body (a leg)) of the user 110 and may apply an external force of a resistance force to a body motion of the user 110. The resistance force may be a force impeding the body motion of the user 110, which is applied in an opposite direction to the direction of the body motion of the user 110. The term "resistance force" may also be referred to as an "exercise load". In an example embodiment, the wearable device 100 may apply a resistance force to a body motion of the user 110 by adjusting tension of a cable 30 or 35 connected, directly or indirectly, to a body coupling component 40 or 45 grabbed by a hand of the user 110. The tension of the cable 30 or 35 may represent a force (e.g., torque) applied to the cable 30 or 35 wherein the force is generated by an actuator (e.g., an actuator 440 or 445 of FIG. 4) of the wearable device 100.

In an example embodiment, the wearable device 100 may operate in an exercise posture guide mode that guides an exercise posture of the user 110. In the exercise posture guide mode, the wearable device 100 may estimate a position of the body coupling component 40 or 45 of the wearable device 100 and may adjust the tension of the cable 30 or 35 based on the position of the body coupling component 40 or 45. The wearable device 100 may estimate that the position of the body coupling component 40 or 45 to be the position of the hand of the user 110 and may determine whether the position of the hand of the user (or a change in the position of the user's hand over time) corresponds to an intended exercise posture. The body coupling component 40 or 45 may be a component for connecting or fixing the cable 30 or 35 to a portion of the body of the user 110. The body coupling component 40 and/or 45 may be, for example, in a form of a handle, a band, a frame, a bracelet, a loop, a strap, and a glove, but the example is not limited thereto. In some embodiments, for ease of description, descriptions are provided based on an example in which the body coupling component 40 or 45 is in the form of a handle. However, the scope of the embodiments shall not be limited thereto.

The intended exercise posture may be defined as a path of a hand or an arm to move or a specific exercise posture. The wearable device 100 may adjust the tension of the cable 30 or 35 to a low value when a change in the position of the user's hand over time corresponds to the intended exercise posture and when the change in the position of the user's hand over time does not correspond to the intended exercise posture, the wearable device 100 may induce the user's hand to move to an exercise posture intended by the user 110 by adjusting the tension of the cable 30 or 35 to a high value. The tension of the low value may cause the user 110 to feel small resistance or not feel the resistance from the cable 30 or 35 and the tension of the high value may cause the user 110 to feel relatively great resistance from the cable 30 or 35. The low value and the high value of the tension may be relational and may indicate a lower value or a higher value than a specific reference value, respectively.

In an example embodiment, the wearable device 100 may operate in a strength exercise assistance mode for enhancing the strength of the user 110. In the strength exercise assistance mode, the wearable device/apparatus 100 may hinder a body motion of the user 110 or provide resistance to a body motion of the user 110 by applying a resistance force to the body of the user 110 through the cable 30 or 35. In an example embodiment, the wearable device 100 may further enhance an exercise effect by providing an exercise load to an arm motion of the user 110. The wearable device 100 may set the resistance force of the cable 30 or 35 to be high when the user 110 moves to the intended exercise posture and when the user 110 moves in a different direction from the intended exercise posture, the wearable device 100 may set the resistance force of the cable 30 or 35 to be low. Through this, the user 110 may perform a strength exercise with a preferable exercise posture.

In an example embodiment, the wearable device 100 may operate in a physical ability measurement mode for measuring a physical ability of the user 110. The wearable device 100 may measure motion information of the user 110 using a sensor (e.g., an inertial sensor, a force sensor, and an angle sensor) included in the wearable device 100 during the exercise of the user 110 and may assess the physical ability of the user 110 based on the measured motion information. For example, an exercise ability indicator (e.g., muscular strength, endurance, balance, or exercise motion) of the user 110 may be estimated through the motion information of the user 110 measured by the wearable device 100.

In embodiments of the present disclosure, for convenience of description, the wearable device 100 is described as an example of an upper body-wearing wearable device, as illustrated in FIGS. 1A and 1B, but the embodiments are not limited thereto. As described above, the wearable device 100 may be worn on other body parts and the shape and configuration of the wearable device 100 may vary depending on the body part on which the wearable device 100 is worn. For example, the wearable device 100 may be modified and used to assist a leg exercise as described in FIG. 14.

The wearable device 100 according to an example embodiment may include a first wearing part 10, a main body module 20, the cables 30 and 35 connected, directly or indirectly, to an actuator of the main body module 20, the coupling components 40 and 45 connected, directly or indirectly, to the cables 30 and 35 and connected or fixed to a body part (e.g., hands, wrists, arms, and fingers) of the user 110, and second wearing parts 50 and 55. The wearable device 100 may further include a sensor (not shown) configured to measure a hand motion of the user 110 and generate motion data corresponding to the hand motion of the user. Some (e.g., the second wearing parts 50 and 55) of the components may be omitted and another component (e.g., a third wearing part worn on an upper arm) may be added to the wearable device 100.

The first wearing part 10 may be worn on the body of the user 110. For example, the first wearing part 10 may be worn on the upper body of the user 110. The first wearing part 10 may fit the upper body of the user 110 and support a portion of the upper body of the user 110. The first wearing part 10 may adhere the main body module 20 to the upper body of the user 110 to prevent or reduce chances of the main body module 20 fixed to the first wearing part 10 from being shaken by the motion of the user 110. In an example embodiment, the first wearing part 10 may include an elastic material.

Figure 4:
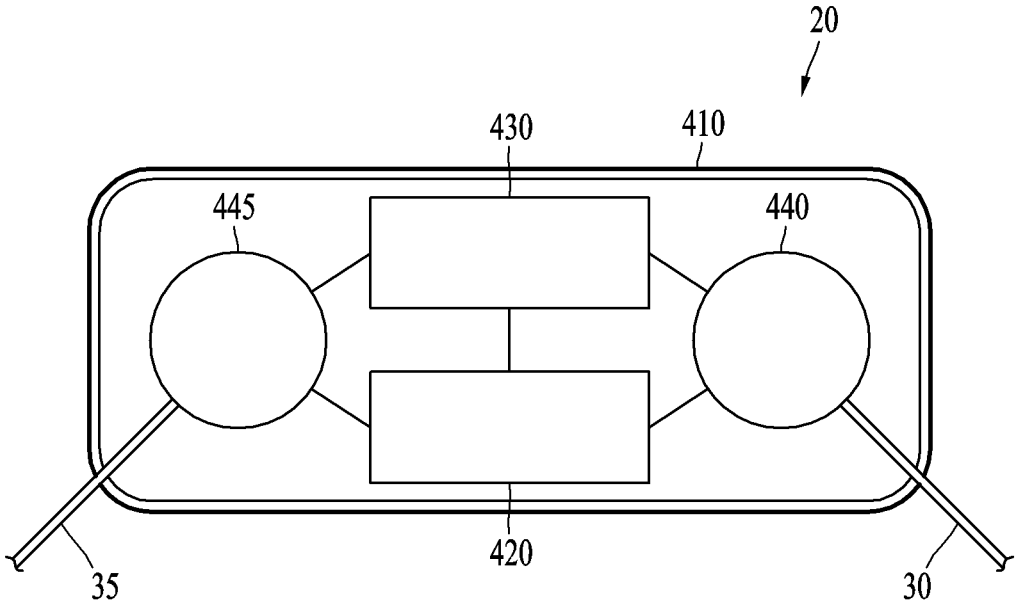
FIG. 4 is a diagram illustrating components of a main module of a wearable device according to an example embodiment.

The main body module 20 may include an actuator (e.g., the actuators 440 and 445 of FIG. 4) connected, directly or indirectly, to the cable 30 or 35 and configured to adjust tension applied to the cable 30 or 35, a processor (e.g., a processor 510 of FIG. 5) configured to control the actuator, and a battery (e.g., a battery 430 of FIG. 4). In an example embodiment, the main body module 20 may guide the user 110 on a preferred exercise posture or may assist a strength exercise of the user 110 by adjusting a magnitude of tension transmitted to the body coupling components 40 and 45 of the user 110 through the cables 30 and 35. The main body module 20 may adjust the tension applied to the cables 30 and 35 by controlling the actuator based on a position of a hand (or an arm) of the user 110. The tension applied to the cables 30 and 35 may be transmitted to the body coupling components 40 and 45 held by the user 110. The main body module 20 may obtain sensor data related to a position of the hand of the user 110 through at least one sensor (not shown) and may estimate a position of a hand and a posture of an arm of the user 110 based on the sensor data. The sensor data may include measured data on the motion and/or rotation of the user's hand. The at least one sensor may include, for example, an inertial measurement unit (IMU). The at least one sensor may be included in, for example, the second wearing parts 50 and 55, the body coupling components 40 and 45, a third wearing part (not shown) worn on an upper arm, and/or another wearable device (e.g., a watch-type wearable device). The main body module 20 and the at least one sensor may be connected to each other by wire or wirelessly.

When the first wearing part 10 is worn on an upper body of the user 110, the main body module 20 may be positioned on a backside (e.g., the back) of the upper body of the user 110. However, the example is not limited thereto. For example, the main body module 20 may be positioned on a front side (e.g., the chest) of the upper body. The main body module 20 may include a display (not shown) for visually showing information, such as a current operation state of the wearable device 100. The display may include a light module (e.g., a light module 570 of FIG. 5) that is able to output light in various colors, intensities, and/or patterns. The light module may include a light-emitting diode (LED) and may provide information related to the wearable device 100 through a color and/or an output pattern of the LED.

An end of the cable 30 or 35 may be connected, directly or indirectly, to the body coupling component 40 or 45. In an example embodiment, the body coupling components 40 and 45 and the second wearing parts 50 and 55 may be worn to be positioned on hands and wrists of the user 110, respectively. The body coupling components 40 and 45 may have shapes that the user 110 is able to grip by hand, but the shapes of the body coupling components 40 and 45 are not limited to the described embodiments. The body coupling components 40 and 45 may have shapes that may be fixed to a portion of the hand or arm of the user 110. The cables 30 and 35 may be connected, directly or indirectly, to the actuator (e.g., the actuators 440 and/or 445 of FIG. 4) in the main body module 20 and the tension and/or the length may vary depending on the motion of a hand (or an arm) of the user 110. The cable 30 or 35 may be an elastic cable, an inelastic cable, or a combination thereof.

The second wearing part 50 or 55 may position an end of the cable 30 or 35 to be closely in contact with the body of the user 110 even in a state in which the user 110 does not grip the body coupling component 40 or 45. The second wearing part 50 or 55 may include, for example, a sensor, such as an inertial sensor and a biometric sensor, a communication module (not shown) for communicating with the sensor, and a battery (not shown) for power supply. For example, the biometric sensor may sense a heart rate of the user 110.

In the illustrated embodiment, the body coupling components 40 and 45 and the second wearing parts 50 and 55 have separate shapes from each other, but depending on embodiments, the body coupling components 40 and 45 and the second wearing parts 50 and 55 may be manufactured to have one shape (e.g., in the form of gloves) as an integral body. In the wearable device 100, the cables 30 and 35, the body coupling components 40 and 45, and the second wearing parts 50 and 55 are respectively provided as two for both arms of the user 110, but only one of each may be included for only one arm. In addition, the wearable device 100 may operate for both arms or may operate for only one arm. For example, when the user 110 performs exercise only on a right arm (or a right hand), the user 110 may grip the first body coupling component 40 and may perform exercise on the right arm based on resistance transmitted by the first cable 30.

Figure 1C:
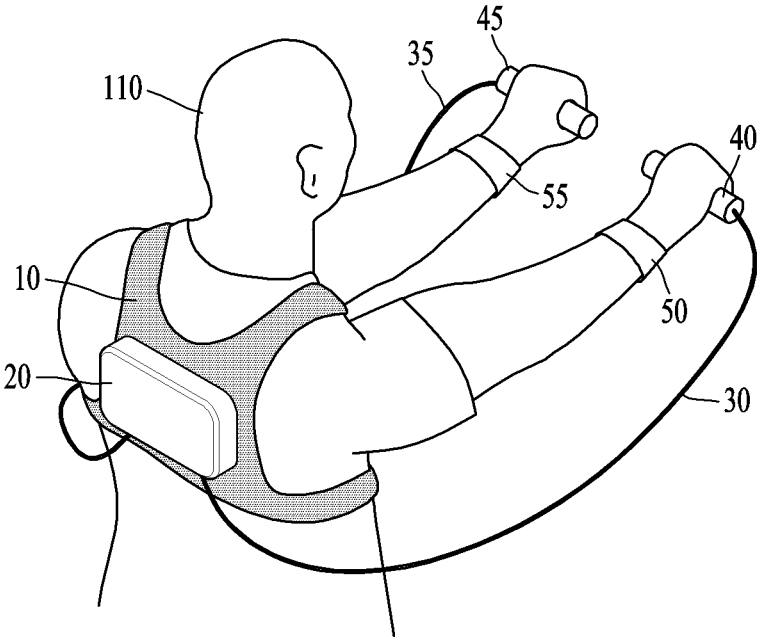
FIGS. 1C and 1D are diagrams illustrating an application using a wearable device according to an example embodiment.
Figure 1D:
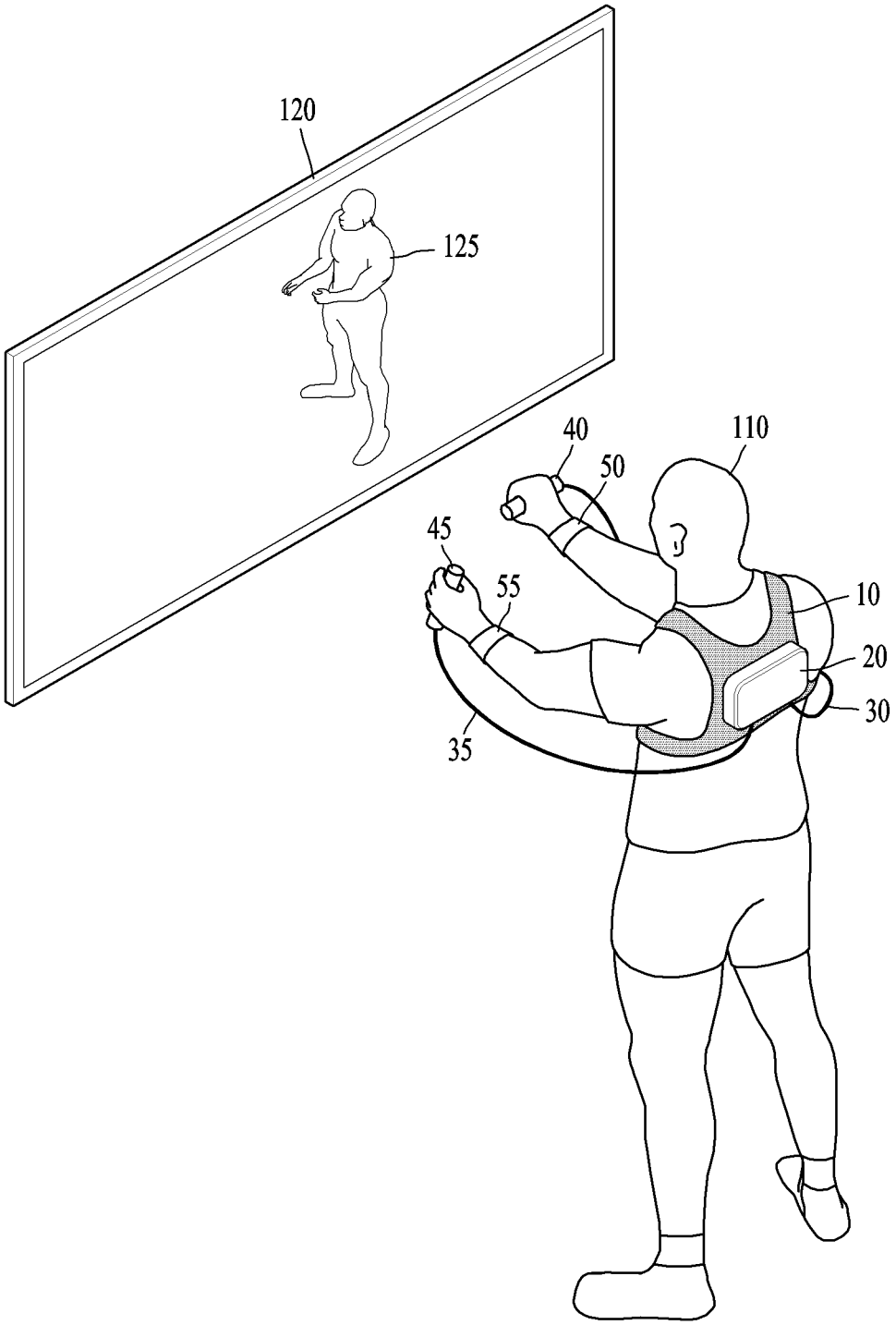

FIGS. 1C and 1D are diagrams illustrating an application using a wearable device according to an example embodiment.

Referring to FIGS. 1C and 1D, the user 110 may wear a wearable device (e.g., the wearable device 100 of FIG. 1A) and may train an exercise posture using the wearable device or may perform various exercises. For example, the user 110 may perform various exercises such as weight training, boxing, Pilates, or yoga while wearing the wearable device. In an example embodiment, the wearable device may guide the user 110 to naturally move an arm in a preferred exercise posture by providing resistance through the cable 30 or 35 when the user 110 moves the arm in a posture that is not the preferred exercise posture. Alternatively, the wearable device may assist the user 110 to perform a strength exercise in a preferred exercise posture by providing high resistance when the user moves in the preferred exercise posture.

In an example embodiment, a view of the user 110 while wearing the wearable device and exercising may be displayed on a display device 120 as shown in FIG. 1D. In an example embodiment, a current posture of the user 110 may be sensed through a sensor or another device (e.g., a camera) provided in the wearable device and an avatar, a character, or an actual image 125 corresponding to the sensed posture of the user 110 may be output on the display device 120. The camera for sensing a posture of the user 110 may be provided in, for example, the display device 120 or another wearable device (e.g., an augmented reality (AR) device or a virtual reality (VR) device) worn by the user 110. For example, at least one wide-angle camera may be arranged on the outside of a head mounted display (HMD) or a glasses-type AR device (or a VR device) and a posture of an upper body including a posture of an arm of the user 110 may be estimated by detecting a position of the body coupling component 40 or 45 or the hand of the user 110 in an image captured by the wide-angle camera.

The display device 120 may be an electronic device connected to the wearable device by wire or wirelessly and may include, for example, a television, a monitor, a mobile device, or a tablet.

In an example embodiment, the wearable device may implement a resistance force that varies depending on a body motion of the user 110 by performing variable tension control based on the posture of the user 110. The variable tension control may refer to control of a magnitude of the tension applied to a cable (e.g., the cables 30 and 35 of FIG. 1A) of the wearable device based on the motion of the user 110 when the user 110 wears the wearable device and moves. Since the wearable device adjusts the tension applied to the cable based on the motion of the user 110, the wearable device may perform control the tension to vary depending on the motion of the user 110. Traditional impedance control may refer to the control of a control parameter of inertia, damping, and/or stiffness in a task space. In the present disclosure, since the variable tension control by the wearable device may control virtual mass (inertia), virtual damping (attenuation), and/or virtual spring (stiffness) in a three-dimensional (3D) space according to the motion of the user 110, the variable tension control may be construed as variable impedance control.

The wearable device may estimate a position of a hand (or an arm) of the user 110 through a sensor and may implement personalized variable tension control in a 3D space based on a relative position between the hand (or the arm) and the user's torso (or the wearable device) obtained by position estimation. The variable tension control may be control of the tension applied to the cable 30 or 35 of the wearable device based on the motion of the arm of the user 110 by adjusting characteristics of the virtual mass (inertia), the virtual damping (attenuation), and the virtual spring (stiffness). When the user 110 wears the wearable device and moves for exercise, the user 110 may feel the tension applied to the cable 30 or 35 of the wearable device. Since a force generated by the wearable device is transmitted to the user 110 through the cable 30 or 35 accompanied with vibration, the user 110 may feel the force of a vibrational system consisting of or including elements of the mass, damping, and stiffness. In the vibrational system, the mass may be an indicator of resistance to a change in motion and may be referred to as an inertia force and the damping may be dissipation of energy based on time or distance and may be referred to as a damping force representing a gradual decrease in an amplitude over time. The stiffness may be a change ratio of a force to a change in a translation displacement of the cable 30 or 35, which is an elastic element, and may be referred to as an elastic restoring force.

In an example embodiment, when the user 110 attempts to move their hand or arm while holding the body coupling component 40 or 45, the user 110 may feel a resistance force caused by the tension applied to the cable 30 or 35 of the wearable device. The wearable device may implement the variable tension control by changing characteristics of the inertia, damping, and stiffness of the tension applied to the cable 30 or 35 within a working distance. The wearable device may transmit a virtual medium feeling to the user 110 by adjusting characteristics of the mass, damping, and stiffness of virtual tension generated by the cable 30 or 35. For example, the wearable device may implement a virtual wall at a specific distance in front of the position of the user 110 and may provide the user 110 with a sense of a solid wall or a soft wall by changing stiffness and damping characteristics. The mass, damping, and stiffness characteristics of the tension may be determined by media of both ends to which a vibrating body is connected, but the wearable device may provide the cables 30 and 35 with tension based on virtual mass, virtual damping, and virtual stiffness rather than the tension determined by the media connected to the cables 30 and 35. The virtual mass, virtual damping, and virtual stiffness may respectively represent mass, damping, and stiffness elements of tension determined by the wearable device. Through the variable tension control that may create the virtual mass, the virtual damping, and the virtual stiffness, tension based on negative mass, negative damping, and/or negative stiffness, which are not allowed in reality, may be provided to the cables 30 and 35, and thus, vibration may be generated or a different resistance sense than in the real world may be provided to the user 110. Due to the variable tension control, a soft wearable device that applies a force to the user 110 through the cables 30 and 35 as the wearable device described herein may effectively assist a strength exercise of the user 110 and may guide a preferable exercise posture.

In an example embodiment, the user 110 may receive virtual feedback about resistance provided by the wearable device by confirming, through the display device 120 or another wearable device (e.g., an AR device or a VR device) worn by the user 110, an impedance distribution in a space formed in a surrounding space of the user 110. The impedance distribution may represent a distribution of impedance values in the surrounding space of the user 110 wherein the impedance values may be a resistance force felt by the user by the tension of the cable of the wearable device that is able to generate virtual mass, virtual damping, and virtual stiffness. For example, the impedance distribution in space may have a shape of a 3D impedance map.

In an example embodiment, the wearable device may be used for an exergame. The user 110 may wear the wearable device and may play a game while viewing the display device 120 or a display of another wearable device (an AR device or a VR device). The wearable device may adjust stiffness, damping, and inertia characteristics of the cables 30 and 35 to transmit defined characteristics (e.g., stiffness, damping, inertia, and vibration) of an object shown in gaming content to the user 110 through the cables 30 and 35.

Figure 2:
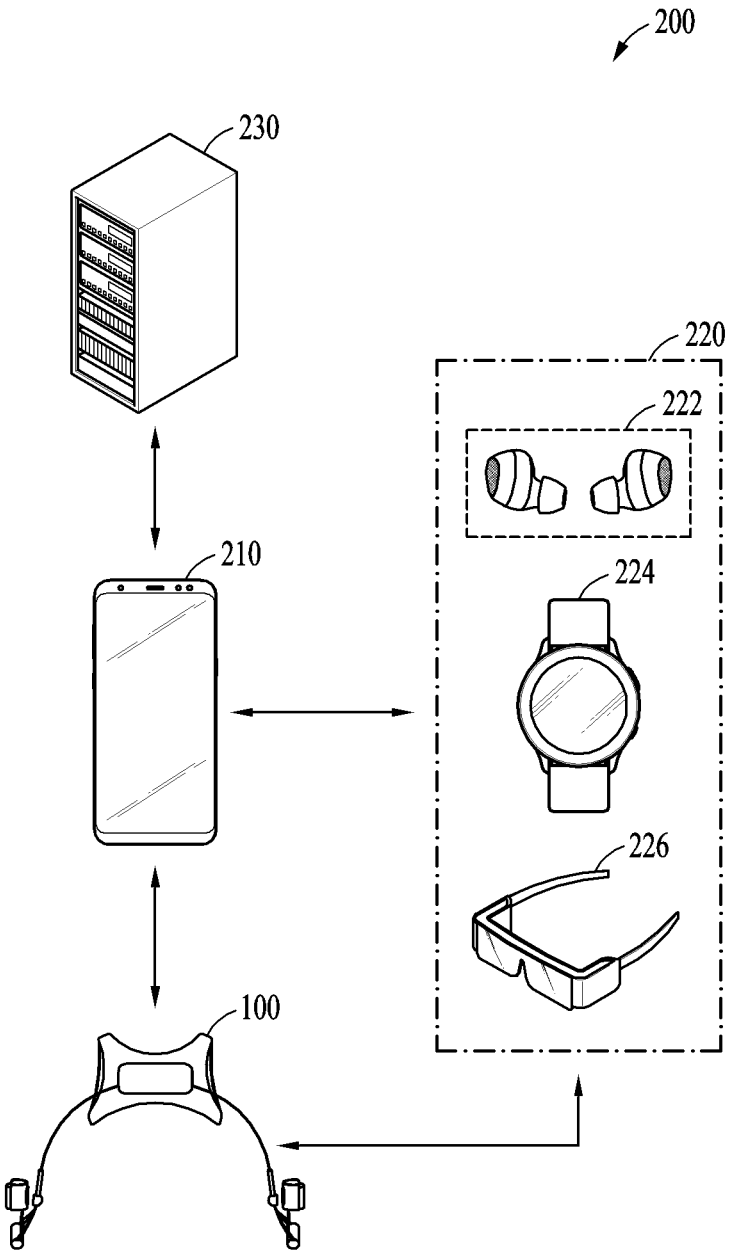
FIG. 2 is a diagram illustrating a system including a wearable device and an electronic device according to an example embodiment.

FIG. 2 is a diagram illustrating a system including a wearable device and an electronic device according to an example embodiment.

Referring to FIG. 2, a system 200 may include the wearable device 100, an electronic device 210, another wearable device 220, and a server 230. In an example embodiment, at least one (e.g., the other wearable device 220 or the server 230) of these devices may be omitted from the system 200, or one or more other devices (e.g., an exclusive controller device of the wearable device 100) may be added thereto.

In an example embodiment, the wearable device 100 may be worn on a body of a user, may measure a body motion of the user, and may provide the user with resistance according to the body motion of the user. For example, the wearable device 100 may be worn on the upper body of the user, may measure an arm motion of the user, and may generate torque to assist exercise of the user based on the arm motion. The wearable device 100 may guide the user on a preferable exercise posture or may assist the strength exercise of the user. For example, in a strength exercise assistance mode, the wearable device 100 may provide the user with a resistance force through a cable (e.g., the cables 30 and 35 of FIGS. 1A) to hinder a body motion of the user to enhance an exercise effect of the user. The wearable device 100 may adjust the strength of the resistance force applied to the user according to exercise intensity selected by the user.

The electronic device 210 may communicate with the wearable device 100, may remotely control the wearable device 100, and may provide the user with information (e.g., state information of the wearable device 100 and motion information of the user measured by the wearable device 100) received from the wearable device 100. The electronic device 210 may receive the sensor data obtained by a sensor in the wearable device 100 from the wearable device 100 and determine a motion of the user based on the received sensor data. In an example embodiment, when the user moves wearing the wearable device 100, the wearable device 100 may obtain sensor data including motion information of the user using sensors and transmit the obtained sensor data to the electronic device 210. The electronic device 210 may determine a motion or posture of the user from the sensor data and evaluate an exercise posture of the user based on the determined motion or posture. The electronic device 210 may provide the user with an exercise posture measured value and exercise posture evaluation information related to the exercise posture of the user through a display.

In an example embodiment, the user may execute a program (e.g., an application) to control the wearable device 100 through the electronic device 210 and the user may adjust an operation mode of the wearable device 100, a torque property output through a cable, brightness of a light module, and the like, through the program. The electronic device 210 may be a device in various forms. For example, the electronic device 210 may include a portable communication device (e.g., a smartphone), a computer device, a portable multimedia device, or a home appliance (e.g., a television, an audio device, or a projector device), but examples are not limited to the foregoing devices.

In an embodiment, the electronic device 210 may be connected to the server 230 by using short-range wireless communication or cellular communication. The server 230 may receive user profile information of the user of the wearable device 100 from the electronic device 210 and store and manage the received user profile information. The user profile information may include, for example, information about at least one of the name, age, gender, height, weight, or body mass index (BMI). The server 230 may receive exercise history information about an exercise performed by the user from the electronic device 210 and store and manage the received exercise history information. The server 230 may provide the electronic device 210 with various exercise programs or physical ability measurement programs to be provided to the user.

According to an embodiment, the wearable device 100 and/or the electronic device 210 may be connected to the other wearable device 220. The other wearable device 220 may include, for example, wireless earphones 222, a smart watch 224, or an AR or VR device 226, but is not limited thereto. The wearable device 100, the electronic device 210, and the other wearable device 220 may be connected to each other via wireless communication (e.g., Bluetooth communication or wireless fidelity (Wi-Fi) communication).

In an embodiment, the wearable device 100 may provide feedback (e.g., visual feedback, auditory feedback, or haptic feedback) corresponding to a state of the wearable device 100 in response to a control signal received from the electronic device 210. For example, the wearable device 100 may provide visual feedback through a light module (e.g., a light module 570 of FIG. 5) and may provide auditory feedback through an audio output module (e.g., an audio output module 560 of FIG. 5). The wearable device 100 may include a haptic module (e.g., a haptic module 580 of FIG. 5) and provide haptic feedback in the form of vibration to the body of the user through the haptic module. The electronic device 210 may also provide feedback (e.g., visual feedback, auditory feedback, or haptic feedback) corresponding to the state of the wearable device 100.

Figure 3:
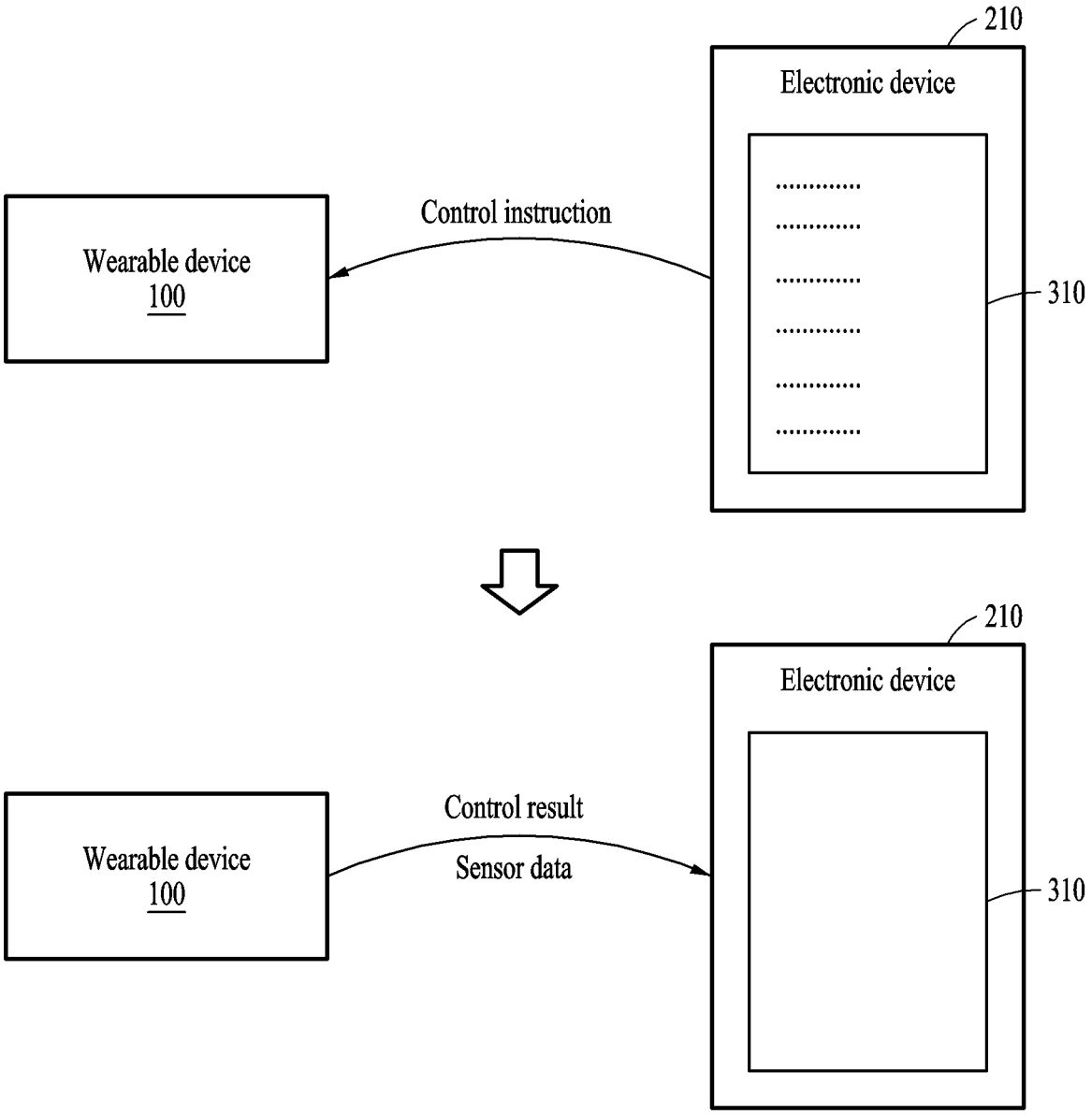
FIG. 3 is a diagram illustrating an interaction between a wearable device and an electronic device according to an example embodiment.

FIG. 3 is a diagram illustrating an interaction between a wearable device and an electronic device according to an example embodiment.

Referring to FIG. 3, the wearable device 100 may communicate with the electronic device 210. For example, the electronic device 210 may be a user terminal of a user who uses the wearable device 100 or a controller device dedicated to the wearable device 100. In an example embodiment, the wearable device 100 and the electronic device 210 may be connected to each other through short-range wireless communication (e.g., Bluetooth™ or Wi-Fi communication).

In an example embodiment, the electronic device 210 may check a state of the wearable device 100 or execute an application to control or operate the wearable device 100. A screen of a user interface (UI) may be displayed to control an operation of the wearable device 100 or determine an operation mode of the wearable device 100 on a display 310 of the electronic device 210 through the execution of the application. The UI may be, for example, a graphical user interface (GUI).

In an example embodiment, the user may input an instruction to control the operation of the wearable device 100 or change settings of the wearable device 100 through the GUI screen on the display 310 of the electronic device 210. The electronic device 210 may generate a control instruction (or control signal) corresponding to an operation control instruction or a setting change instruction input by the user and transmit the generated control instruction (or control signal) to the wearable device 100. The wearable device 100 may operate based on the received control instruction (or control signal) and may transmit a control result based on the control instruction (or control signal) and/or sensor data measured by a sensor module (e.g., a sensor module 550 of FIG. 5) of the wearable device 100 to the electronic device 210. The electronic device 210 may provide the user with result information derived by analyzing the control result and/or the sensor data through the display 310.

FIG. 4 is a diagram illustrating components of a main module of a wearable device according to an example embodiment.

Referring to FIG. 4, the main body module 20 may include a circuit module 420, a battery 430, and one or more actuators 440 and 445. Each component of the main body module 20 may be disposed in a module case 410 and may be protected by the module case 410. The battery 430 may supply power to each component of the main body module 20. The actuators 440 and 445 may be connected, directly or indirectly, to the cables 30 and 35 and may adjust tensions of the cables 30 and 35, respectively. In an example embodiment, the first actuator 440 may be connected, directly or indirectly, to the first cable 30 and the second actuator 445 may be connected, directly or indirectly, to the second cable 35. The first cable 30 may be for an exercise of a right arm of a user and the second cable 35 may be for an exercise of a left arm of the user. The first actuator 440 and the second actuator 445 may each include a motor configured to generate torque by receiving power from the battery 430. Each "actuator" herein may include a motor and/or circuitry.

In an example embodiment, the circuit module 420 may include a circuit for controlling a wearable device (e.g., the wearable device 100 of FIG. 1A). The circuit module 420 may include at least one processor (e.g., a processor 510 of FIG. 5) and a memory (e.g., a memory 520 of FIG. 5) for controlling operations of the actuators 440 and 445. The actuators 440 and 445 may generate an external force (or torque) to be applied to the body of the user based on a control signal generated by the processor. For example, the actuators 440 and 445 may generate a resistance force applied to arms or hands of the user. The resistance force may be shown as, for example, the tension transmitted by the cables 30 and 35. The actuators 440 and 445 may each be controlled by the processor. For example, when the first actuator 440 performs an operation of pulling the first cable 30, the second actuator 445 may perform an operation of maintaining the second cable 35 in a fixed state. The actuators 440 and 445 may each include a motor and the processor may adjust the intensity and characteristic of tension generated by the motor by adjusting a voltage and/or a current supplied to the motor. The motor may perform a control operation of pulling, extending, or fixing the cable based on the control signal. The control operation with respect to the cable may be performed by a power source other than the motor. A description of the control operation of the cable by the motor is provided later with reference to FIGS. 15, 16, and 17.

Each "processor" herein includes processing circuitry, and/or may include multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

Each embodiment herein may be used in combination with any other embodiment(s) described herein.

Figure 5:
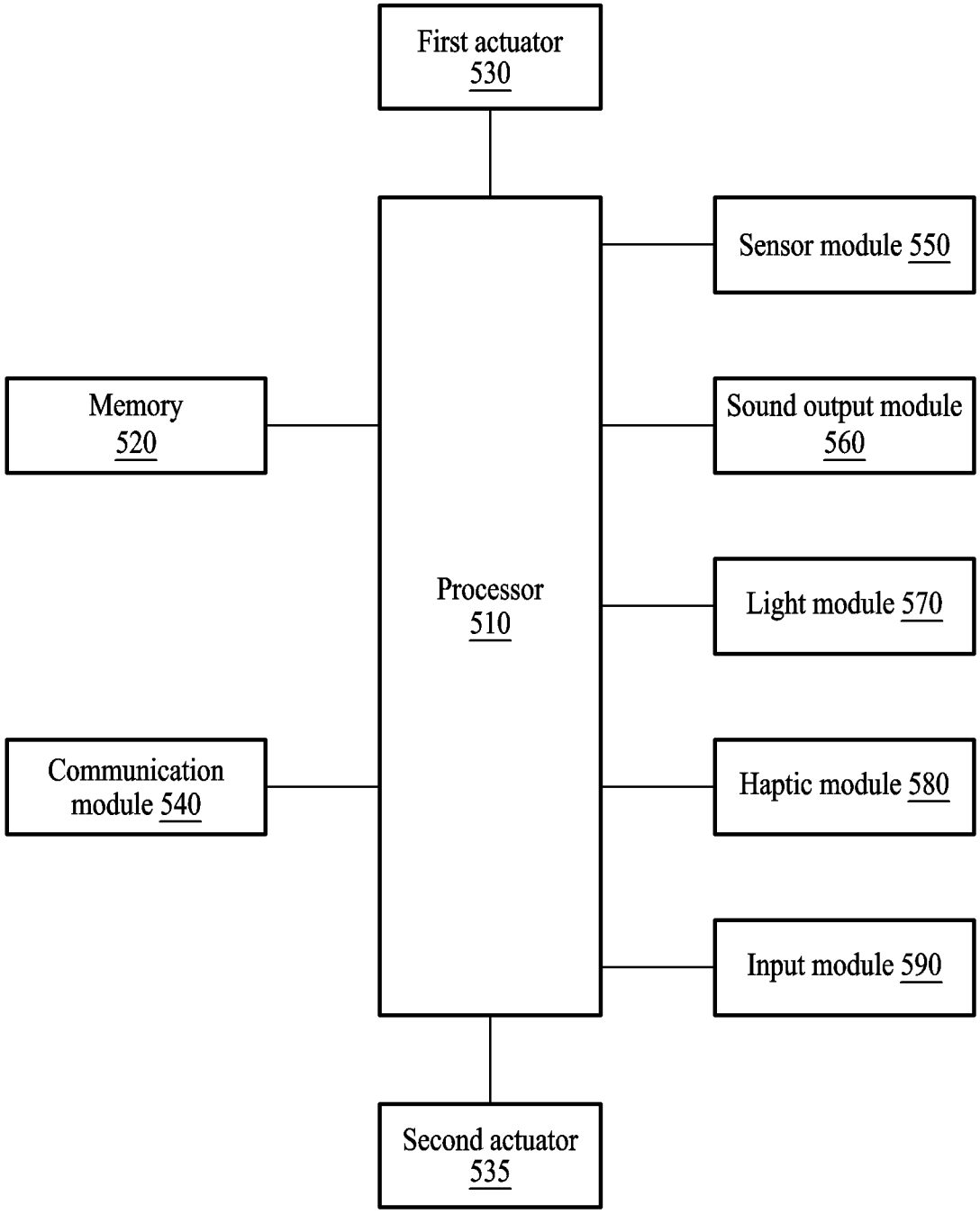
FIG. 5 is a diagram illustrating components of a wearable device according to an example embodiment.

FIG. 5 is a diagram illustrating components of a wearable device according to an example embodiment.

Referring to FIG. 5, the wearable device 100 may include a processor 510, a memory 520, actuators 530 and 535, a communication module 540, a sensor module 550, an audio output module 560, a light module 570, a haptic module 580, and an input module 590. In an example embodiment, at least one (e.g., the light module 570, the haptic module 580, and the input module 590) of these components may be omitted from the wearable device 100, or one or more other components may be added to the wearable device 100.

The processor 510 may control an overall operation of the wearable device 100, and may generate a control signal to control each component of the wearable device 100. The processor 510 may execute, for example, software to control at least one other component (e.g., a hardware or software component) of the wearable device 100 connected to the processor 510, and may perform a variety of data processing or computation. The software may include an application for providing a GUI. According to an example embodiment, as at least a part of data processing or computation, the processor 510 may store instructions or data received from another component (e.g., the communication module 540) in the memory 520, may process the instructions or the data stored in the memory 520, and may store result data in the memory 520. The processor 510 may include at least one processor and operations of the processor 510 described herein may be performed by the at least one processor. According to an example embodiment, the processor 510 may include at least one of a main processor (e.g., a central processing unit (CPU) or an application processor (AP)) or an auxiliary processor (e.g., a graphics processing unit (GPU), a neural processing unit (NPU), an image signal processor (ISP), a sensor hub processor, or a communication processor (CP)) that is operable independently from or in conjunction with the main processor 510. The auxiliary processor may be implemented separately from the main processor or as a part of the main processor.

The memory 520 may store a variety of data used by at least one component (e.g., the processor 510) of the circuit module. The variety of data may include, for example, software, sensor data, input data or output data for instructions related thereto. The memory 520 may include a volatile memory or a non-volatile memory.

The actuators 530 and 535 may be connected to a cable (e.g., the cables 30 and 35 of FIG. 4) of the wearable device 100 and may adjust the tension of the cable under control of the processor 510. In an example embodiment, the first actuator 530 (e.g., the first actuator 440 of FIG. 4) may be connected to a first cable (e.g., the first cable 30 of FIG. 4) and the second actuator 535 (e.g., the second actuator 445 of FIG. 4) may be connected to a second cable (e.g., the second cable 35 of FIG. 5).

The communication module 540 may support establishing a wired communication channel or a wireless communication channel between the processor 510 and another component of the wearable device 100 or an external electronic apparatus (e.g., the electronic device 210 or the other wearable device 220 of FIG. 2), and performing communication via the established communication channel. For example, the communication module 540 may transmit sensor data and/or exercise information about the exercise performed by the user to an external electronic device. According to an example embodiment, the communication module 540 may include one or more CPs that are operable independently of the processor 510 and that support a direct (e.g., wired) communication or a wireless communication. According to an embodiment, the communication module 540 may include a wireless communication module (e.g., a cellular communication module, a short-range wireless communication module, or a global navigation satellite system (GNSS) communication module), and/or a wired communication module. The wireless communication module may communicate with another component of the wearable device 100 and/or an external electronic device via, for example, Bluetooth™, wireless fidelity (Wi-Fi), advanced and adaptive network technology (ANT), infrared data association (IrDA), a legacy cellular network, a 5G network, a next-generation network, the Internet, or a computer network (e.g., a local area network (LAN) or a wide area network (WAN)).

The sensor module 550 may include a sensor circuit including at least one sensor. The sensor module 550 may include a sensor configured to obtain sensor data that varies depending on a motion of the user. For example, the sensor module 550 may include at least one inertial sensor configured to measure a motion of a hand (or a component of the wearable device 100) of the user and generate motion data corresponding to the motion of the hand (or the component of the wearable device 100) of the user. The inertial sensor may sense X-axis, Y-axis, and Z-axis accelerations and X-axis, Y-axis, and Z-axis angular velocities according to a motion of the user. The inertial sensor may be used to measure at least one of a forward and backward tilt, a left and right tilt, or a rotation of the body of the user. The inertial sensor may be included in a circuit module (e.g., the circuit module 420 of FIG. 4) and the inertial sensor included in the circuit module may generate, for example, motion data corresponding to a motion of an upper body (or a waist) of the user. The sensor module 550 may further include a separate inertial sensor configured to generate motion data corresponding to a hand motion of the user. For example, the sensor module 550 may include an inertial sensor disposed on a second wearing part (e.g., the second wearing parts 50 and 55 of FIG. 1) of the wearable device 100, a body coupling component (e.g., the body coupling components 40 and 45 of FIG. 1), a third wearing part worn on an upper arm, and/or another wearable device (e.g., a watch-type wearable device) and configured to measure a hand motion of the user. Other than the inertial sensor, the sensor module 550 may include a force sensor configured to measure a force transmitted to a cable (e.g., the cables 30 and 35 of FIG. 1) of the wearable device 100, an angle sensor configured to measure an angle of the cable, an encoder configured to measure the length of the cable, a position sensor configured to sense a position of the wearable device 100, a temperature sensor configured to measure a surrounding temperature, a biosignal sensor configured to measure a biosignal of the user, and a proximity sensor configured to measure the proximity of an object.

The sound output module 560 may output a sound signal to the outside of the wearable device 100. The sound output module 560 may include a speaker configured to play back a guiding sound signal (e.g., an operation start sound or an operation error alarm), a sound effect, music content, or a guiding voice based on the state of the wearable device 100. For example, when it is determined that the wearable device 100 is not properly worn on the body of the user, the sound output module 560 may output a guiding voice for notifying the user of abnormal wearing of the wearable device 100 or guiding the user to wear the wearable device 100 normally. The sound output module 560 may output a guiding voice corresponding to exercise evaluation information or exercise result information obtained by evaluating an exercise of the user.

The light module 570 may emit light under the control of the processor 510. In an example embodiment, the light module 570 may include a light source (e.g., an LED) disposed outside a module case (e.g., the module case 410 of FIG. 4). The processor 510 may control the light module 570 to output visual feedback corresponding to a state of the wearable device 100 through the light module 570.

The haptic module 580 may provide haptic feedback to the user under the control of the processor 510. The haptic module 580 may convert an electric signal into a mechanical stimulus (e.g., a vibration or a movement) or an electrical stimulus which may be recognized by a user via their tactile sensation. The haptic module 580 may include, for example, a motor, a piezoelectric element, or an electrical stimulation device.

The input module 590 may receive a command or data to be used by a component (e.g., the processor 510) of the wearable device 100 from the outside (e.g., the user) of the wearable device 100. The input module 590 may include, for example, a key (e.g., a button) circuit or a touch screen.

In an example embodiment, at least one processor 510 may control the first actuator 530 (e.g., the first actuator 440 of FIG. 4) and the second actuator 535 (e.g., the second actuator 445 of FIG. 4). The first actuator 530 and the second actuator 535 may generate tension or torque applied to a cable (e.g., the cables 30 and 35 of FIG. 1A) under the control of the processor 510. When the wearable device 100 includes a body coupling component (e.g., the body coupling components 40 and 45) shown in FIGS. 1A and 1B, the processor 510 may estimate a position of a hand of the user based on motion data corresponding to a hand motion of the user. In an example embodiment, the processor 510 may obtain motion data of the user's hand from an inertial sensor disposed in the second wearing part (e.g., the second wearing parts 50 and 55 of FIGS. 1A to 1D) of the wearable device 100, the body coupling component, the third wearing part worn on the upper arm, and/or other wearable devices (e.g., a watch-type wearable device). The processor 510 may estimate a position of the user's hand at a specific time point by reflecting, in an initial position of the user's hand, a moving direction and a motion amount of the user's hand estimated by the motion data of the user's hand obtained by the inertial sensor. "Based on" as used herein covers based at least on.

The processor 510 may determine a tension value to be applied to the cable at the position of the user's hand based on the position of the user's hand and a tension control model defined with respect to a surrounding space of the user. The processor 510 may control the first actuator 530 and the second actuator 535 to generate tension at the determined tension value on the cable.

The tension control model may be a model that provides a target tension value based on a body part (e.g., a hand, a wrist, an elbow, and a forearm) of the user in the surrounding space of the user. The target tension value may represent the intensity of the tension to be applied to the cable of the wearable device by driving the first actuator 530 and the second actuator 535 of the wearable device. For example, when the user grabs and moves a body coupling component connected to the cable while the user wears the wearable device, the target tension value may correspond to a target value of the tension to be applied to the cable based on a position of the user's hand (corresponding to a position of the body coupling component).

The tension control model may be represented in the form of a 3D impedance map defined with respect to the surrounding space of the user who wears the wearable device 100. The tension control model may be generated through a training process including setting an exercise type, obtaining guide motion data for the exercise of the set exercise type, and determining parameters of the tension control model based on the obtained guide motion data. The guide motion data may be motion data obtained by a motion of the user wearing the wearable device 100 during the training process of the tension control model or motion data received from another device. In this case, the other device may be, for example, a wearable device of an exercise instructor who teaches an exercise posture. The training process of the tension control model may include a process of determining a target path in a 3D space with respect to a motion of the user based on the guide motion data and a process of determining parameters of the tension control model for determining a tension value in the 3D space based on the determined target path.

The processor 510 may control the first actuator 530 and the second actuator 535 to generate, on the cable, a target tension value of the tension control model determined by the position of the user's hand. The tension control model may determine the target tension value based on at least one of a parameter value related to an inertial characteristic, a parameter value related to a damping characteristic, and a parameter value related to a stiffness characteristic, in relation to a tension characteristic. In an example embodiment, at least one of the parameter value related to the inertial characteristic of the tension control model, the parameter value related to the damping characteristic, and the parameter value related to the stiffness characteristic may vary depending on the position of the user's hand (or a motion of the user's hand). For example, at least one of parameter values (e.g., $K_d$, $C_d$, $M_d$) applied to Equation 1 shown below may vary depending on a change in the position of the user's hand and the target tension value determined by the tension control model may vary based on the change in at least one of the parameter values.

The processor 510 may determine motion velocity and motion acceleration at a specific position of the user's hand based on motion data of a body part (e.g., a hand, an elbow, or a forearm) of the user obtained by the inertial sensor (e.g., the second wearing part of the wearable device 100, the body coupling component, the third wearing part, and/or an inertial sensor disposed in another wearable device) and may determine a tension value to be applied to the cable by applying, to the tension control model, a target path defined within the surrounding space of the user, a distance from the position of the user's hand, the motion velocity at the position of the user's hand, and the motion acceleration at the position of the user's hand. In an example embodiment, the tension value applied to the target path and the tension value applied to the surrounding of the target path may be differently determined.

In an example embodiment, the processor 510 may determine a parameter value of a parameter of the tension control model based on whether the operation mode of the wearable device 100 is an exercise posture guide mode for guiding the exercise posture of the user or a strength exercise assistance mode for enhancing the strength of the user. The parameter of the tension control model may correspond to, for example, a parameter (e.g., a parameter corresponding to virtual stiffness, a parameter corresponding to virtual damping, and a parameter corresponding to virtual inertia) applied to the tension control model corresponding to mathematical modeling of Equation 1 shown below. In the exercise posture guide mode, the processor 510 may determine a tension value to be applied to the cable at the position of the user's hand by using the tension control model in which a tension value applied to the surrounding of the target path defined within the surrounding space of the user is set to be greater than a tension value applied to the target path. In the exercise posture guide mode, the processor 510 may guide the user to perform an exercise posture in the target path by applying a small tension value to the cable in the target path, which is a preferable exercise posture, and applying a great tension value to the cable at a position that deviates from the target path through the tension control model. In the strength exercise assistance mode, the processor 510 may determine a tension value to be applied to the cable at the position of the user's hand by using the tension control model in which a tension value applied to the target path is set to be greater than a tension value applied to the surrounding of the target path. In the strength exercise assistance mode, the processor 510 may guide the user to perform the strength exercise in a preferable exercise posture by causing the user to feel high resistance when the user moves their hands in the target path through the tension control model. In the strength exercise assistance mode, a parameter value of the tension control model may vary depending on set exercise intensity. For example, as the exercise intensity increases, the parameter value of the tension control model may vary to increase the intensity of the tension applied to the cable.

Figure 6:
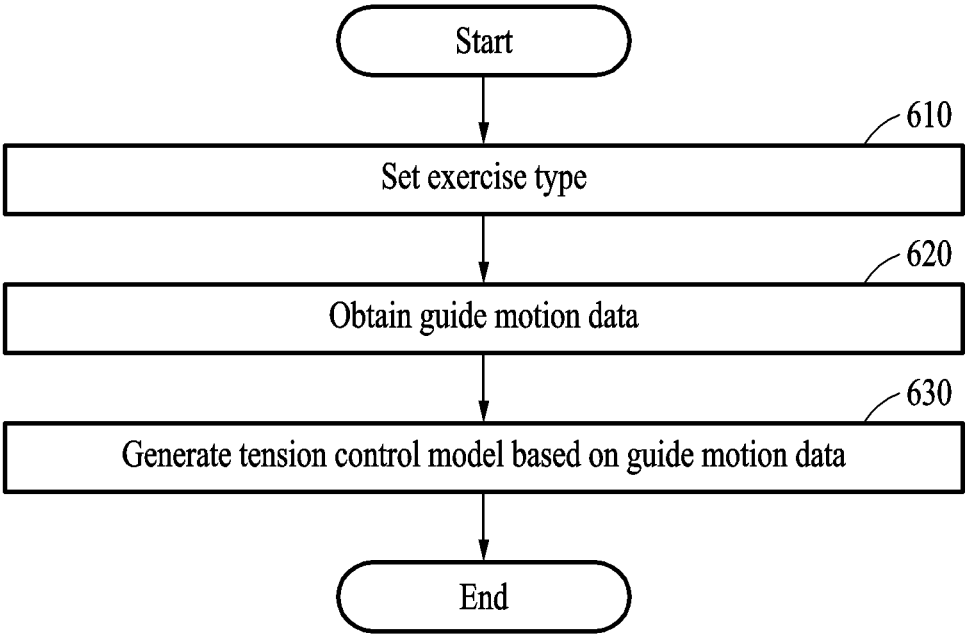
FIG. 6 is a flowchart illustrating a process of generating a tension control model according to an example embodiment.

FIG. 6 is a flowchart illustrating a process of generating a tension control model according to an example embodiment.

In an example embodiment, the wearable device 100 may generate a tension control model corresponding to an exercise type (or an exercise sort) of the user. When the user selects a specific exercise type through a user input, the wearable device 100 may obtain guide motion data including information about a preferable exercise posture (or an exercise motion) for the selected exercise type. The wearable device 100 may generate the tension control model for the selected exercise type based on the obtained guide motion data.

Referring to FIG. 6, in operation 610, an exercise type (or an exercise sort), which is a target of the tension control model, may be set. In an example embodiment, the user may select an exercise type (e.g., bench press, shoulder press, and rowing) through an application of an electronic device (e.g., the electronic device 210 of FIG. 2) communicating with the wearable device 100 and may initiate a process of generating a tension control model for the selected exercise type.

In operation 620, the wearable device 100 may obtain guide motion data for the exercise of the exercise type set in operation 610. In an example embodiment, the user may perform an exercise posture with the help of an exercise instructor who teaches the exercise posture (or exercise motion) while wearing the wearable device 100 and motion data about the exercise posture performed by the user may be obtained by a sensor (e.g., an inertial sensor) included in the wearable device 100. In another embodiment, the exercise instructor who teaches the exercise posture may wear a wearable device that is the same as or similar to the wearable device 100 and as the exercise instructor performs an exercise posture while wearing the wearable device, guide motion data may be obtained through a sensor (e.g., an inertial sensor) included in the wearable device. The guide motion data obtained by the wearable device of the exercise instructor may be transmitted from the wearable device of the exercise instructor and the wearable device 100 of the user may receive the guide motion data transmitted from the wearable device of the exercise instructor via a communication module (e.g., the communication module 540 of FIG. 5). The communication module may receive the guide motion data from the wearable device of the exercise instructor via wired communication or wireless communication (e.g., Bluetooth communication and Wi-Fi communication). After the motion trajectory related to the exercise posture of the exercise instructor is recorded, the motion trajectory may be transmitted to the wearable device 100 as the guide motion data. In another embodiment, the guide motion data may be remotely transmitted via the Internet.

In operation 630, a processor (e.g., the processor 510 of FIG. 5) of the wearable device 100 may generate a tension control model based on the guide motion data. The processor may perform a training process of determining parameters of the tension control model based on the guide motion data obtained in operation 620. The training process of the tension control model may include a process of determining a target path in a 3D space with respect to a motion of the user based on the guide motion data and a process of determining parameters of the tension control model for determining a tension value of the cable in the 3D space based on the determined target path. The processor may determine the trajectory of an exercise posture included in the guide motion data to be the target path in the 3D space and may generate a path function for defining the target path. Based on the generated path function, the processor may determine the parameter value (e.g., a parameter value corresponding to virtual stiffness, a parameter value corresponding to virtual damping, and a parameter value corresponding to virtual inertia) of the tension control model described above and may generate the tension control model represented in the form of an impedance map in the 3D space.

Figure 7:
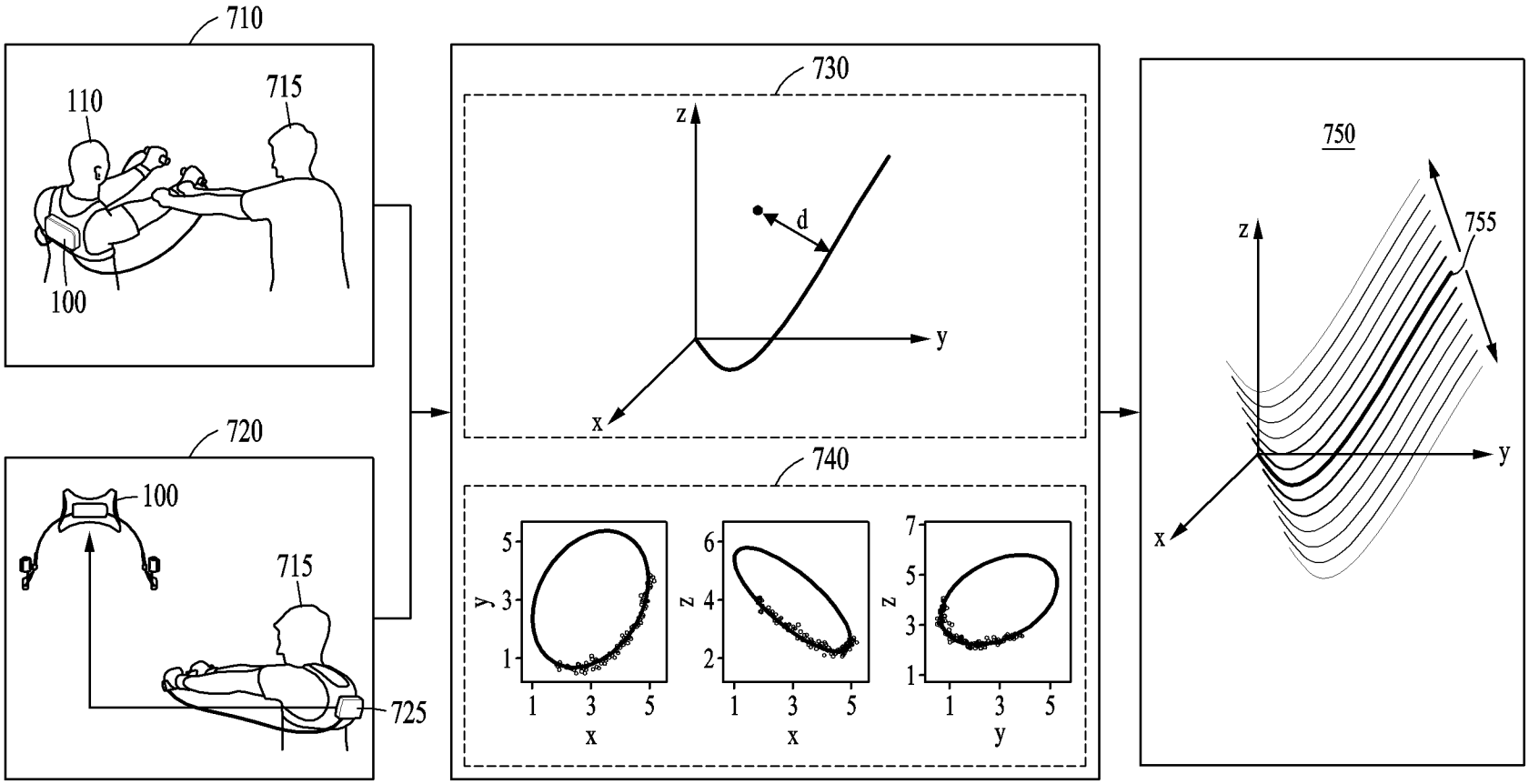
FIG. 7 is a diagram illustrating an example of generating a tension control model according to an example embodiment.

FIG. 7 is a diagram illustrating an example of generating a tension control model according to an example embodiment.

Referring to FIG. 7, a process in which after the user 110 sets an exercise type of bench press, the user 110 generates a tension control model for the bench press is illustrated. In operation 710, the user 110 may perform an exercise posture of bench press with the help of an exercise instructor (or an exercise professional) 715 while the user 110 wears the wearable device 100. The wearable device 100 may obtain guide motion data by recording the trajectory of a motion of a hand (or an arm) when the user 110 performs the exercise posture of bench press using a sensor (e.g., an inertial sensor, a gyro sensor, and an acceleration sensor). For example, motion information (e.g., velocity, acceleration, angular velocity, a moving distance, and a position change) of the user's hand may be estimated through an inertial sensor (e.g., an inertial sensor disposed in the second wearing part (e.g., the second wearing parts 50 and 55 of FIGS. 1A to 1D) of the wearable device 100, the body coupling component, the third wearing part worn on the upper arm, and/or another wearable device (e.g., a watch-type wearable device)).

Alternatively, as in operation 720, the guide motion data may be obtained by performing an exercise posture of bench press while the exercise instructor 715 wears a wearable device 725. Similar to the description provided in operation 710, the wearable device 725 may obtain the guide motion data by recording the trajectory of a motion of a hand (or an arm) of the user when the exercise instructor 715 performs the exercise posture of bench press using the sensor (e.g., the inertial sensor). The processes of operations 710 and 720 may be referred to as kinesthetic teaching.

After the guide motion data is obtained by operation 710 or 720, the processor (e.g., the processor 510 of FIG. 5) of the wearable device 100 may determine a target path in the 3D space with respect to the motion of the user based on the guide motion data. Depending on the processing ability of the wearable device 100, the processor may generate a distance function by calculating a minimum distance between a current position and a path recorded in the guide motion data as operation 730 or may generate a path function by performing a regression analysis of a path recorded in the guide motion data as operation 740. For example, when default processing speed of the wearable device 100 is faster than threshold speed, the path function may be generated by regression analysis and when the default processing speed of the wearable device 100 is not faster than the threshold speed, the distance function may be generated by calculating the minimum distance.

After the distance function or the path function is generated by operation 730 or 740, the processor may generate a tension control model 750 based on the distance function or the path function. The processor may allocate a target tension value to a 3D space based on the distance function or the path function and may generate the tension control model based on the target tension value allocated to the 3D space. As shown in the drawings, the tension control model 750 may be represented in the form of a 3D map showing the target tension value based on a position in the 3D space. The tension control model 750 may represent, for example, a distribution of target tension values according to a 3D position based on a target path 755 in the 3D space. For example, a parameter value of the tension control model 750 may be determined to increase the impedance (or increase the intensity of a tension value) as moving away in one direction from the target path 755. The tension shown in the parameters of the generated tension control model 750 may be determined by Equation 1. Equation 1 may represent a mathematical model of a vibrational system including stiffness, damping, and inertia elements.

$$F = K_d d + C_d \dot{d} + M_d \ddot{d} \qquad \text{[Equation 1]}$$

In this case, $K_d$ may be a parameter value corresponding to virtual stiffness and may be a parameter value related to d, which is a difference value between a distance function value (or a path function) and a current position. $C_d$ may be a parameter value corresponding to virtual damping and may be a parameter value related to moving velocity $\dot{d}$. Ma may be a parameter value corresponding to virtual damping and may be a parameter value related to moving acceleration $\ddot{d}$. F may represent the tension applied to a cable and may be determined to be a sum of characteristic values of the virtual stiffness, virtual damping, and virtual inertia. $K_d$, $C_d$, $M_d$ may be referred to as parameter values of control parameters of the tension control model. Tension F may correspond to a force generated by an actuator of the wearable device 100. Ca and Ma may be a function of which a parameter value is determined depending on a 3D position of the user's hand (e.g., $$C_d = f(x, y, z), M_d = g(x, y, z),$$

wherein (x, y, z) may represent a 3D position value of the user's hand).

The mathematical modeling of Equation 1 above may include a parameter value (e.g., $K_d$) related to an inertial characteristic, a parameter value (e.g., $C_d$) related to a damping characteristic, and a parameter value (e.g., $M_d$) related to a stiffness characteristic, but the scope of embodiment is not limited thereto. The mathematical modeling used as the tension control model may include one or two of a parameter value (e.g., $K_d$) related to an inertial characteristic, a parameter value (e.g., $C_d$) related to a damping characteristic, and a parameter value (e.g., $M_d$) related to a stiffness characteristic. The tension control model may determine a target tension value based on at least one of the parameter value related to the inertial characteristic, the parameter value related to the damping characteristic, and the parameter value related to the stiffness characteristic.

Figure 8:
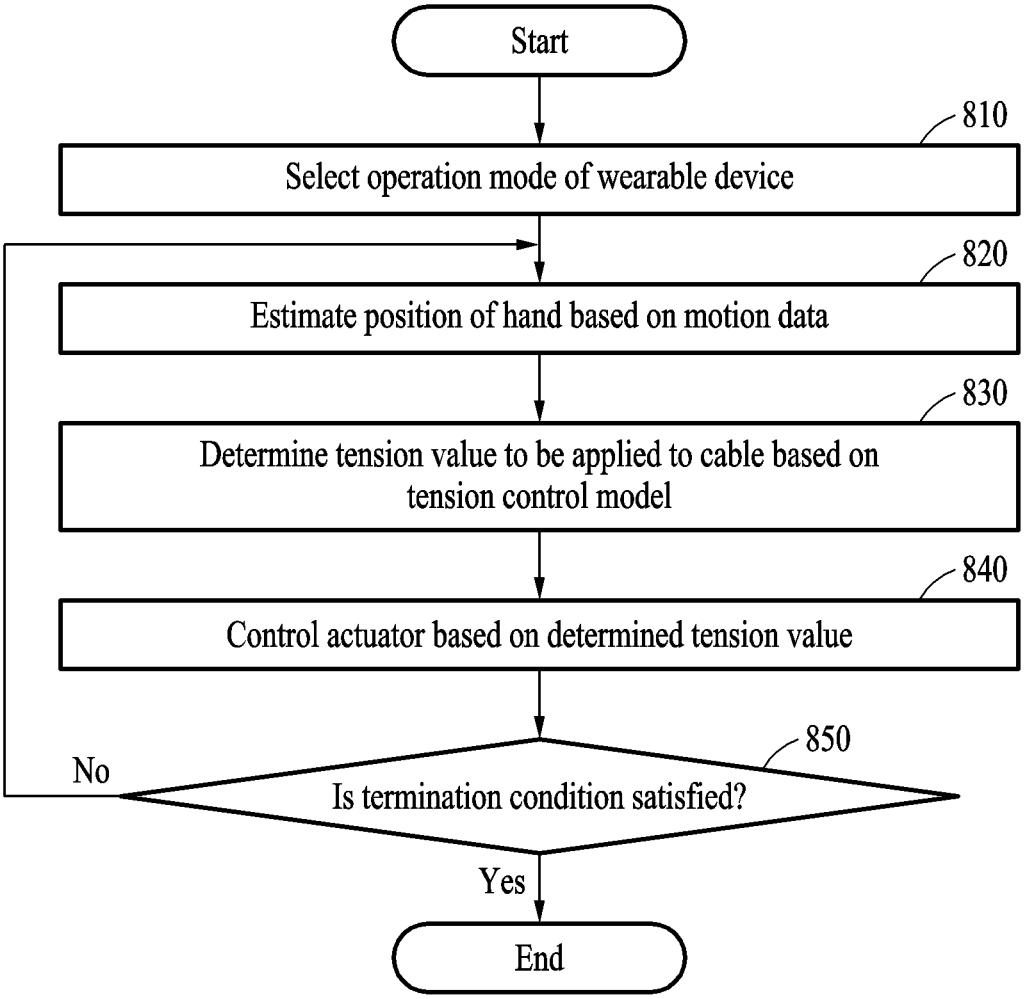
FIG. 8 is a flowchart illustrating operations of an exercise assistance method by a wearable device according to an example embodiment.

FIG. 8 is a flowchart illustrating operations of an exercise assistance method by a wearable device according to an example embodiment. The exercise assistance method in an example embodiment may be performed by a wearable device (e.g., the wearable device 100 of FIG. 1A). In an example embodiment, at least one of operations of FIG. 8 may be simultaneously or parallelly performed with one another, and the order of the operations may be changed. In addition, at least one of the operations may be omitted, or another operation may be additionally performed.

Referring to FIG. 8, in operation 810, an operation mode of a wearable device may be selected. In an example embodiment, a user may select the operation mode of the wearable device from one of an exercise posture guide mode and a strength exercise assistance mode. The exercise posture guide mode may be a mode for correcting or training an exercise posture for an exercise type (e.g., bench press and shoulder press) selected by the user and the strength exercise assistance mode may be a mode for enhancing the strength by performing an exercise of the exercise type selected by the user. Depending on the operation mode of the wearable device selected by the user, variable tension control based on a user motion may be performed. In an example embodiment, operation 810 may be omitted. In this case, without a selection process of the operation mode by the user, an operation mode (e.g., the exercise posture guide mode or the strength exercise assistance mode) set by default on the wearable device may be performed.

In operation 820, the wearable device may obtain motion data corresponding to a motion of the user's hand and may estimate a position of the hand based on the obtained motion data. In an example embodiment, a sensor module (e.g., the sensor module 550 of FIG. 5) of the wearable device may obtain the motion data corresponding to a motion of the user's hand by using a sensor (e.g., an inertial sensor, an acceleration sensor, and a gyro sensor) configured to measure a motion of the user's hand (or arm). A processor (e.g., the processor 510 of FIG. 5) of the wearable device may determine a position of the user's hand based on the motion data obtained by the sensor module.

In operation 830, the wearable device may determine a tension value to be applied to the cable (e.g., the cables 30 and 35 of FIG. 1A) of the wearable device at the position of the user's hand based on the position of the user's hand and the tension control model defined with respect to the surrounding space of the user. The processor of the wearable device may determine a tension value by applying, to the tension control model, a distance between a target path defined within the surrounding space of the user and the position of the user's hand, moving velocity at the position of the user's hand, and motion acceleration at the position of the user's hand. For example, the processor may determine the tension value to be applied to the cable based on a relational expression as Equation 1 or a lookup table (LUT). The LUT may be a table that defines a tension value to be applied to cable based on the distance between the target path defined within the surrounding space of the user and the position of the user's hand, the moving velocity at the position of the user's hand, and the moving acceleration at the position of the user's hand.

Characteristics of parameters of the tension control model may vary depending on the operation mode of the wearable device. In the exercise posture guide mode, the parameter value of the tension control model may be set such that the tension value applied to the surrounding of the target path defined within the surrounding space of the user is greater than the tension value applied to the target path. In the strength exercise assistance mode, the parameter value of the tension control model may be set such that the tension value applied to the target path is greater than the tension value applied to the surrounding of the target path.

In operation 840, the wearable device may control an actuator (e.g., the actuators 440 and 445 of FIG. 4) of the wearable device to generate the tension at the tension value determined in operation 830 on the cable. The wearable device may pull, extend, or fix the cable connected to a motor by controlling rotation of the motor included in the actuator. For example, the wearable device may control a rotation direction, rotation velocity, and/or a rotation angle of the motor to generate the tension at the determined tension value on the cable. The wearable device may generate torque for guiding an exercise posture or a strength exercise through the actuator. The processor of the wearable device may control the actuator to generate a target tension value of the tension control model on the cable determined by the position of the user's hand.

In operation 850, the processor of the wearable device may determine whether a termination condition of operation termination is satisfied. For example, when the user inputs a user input to terminate an operation of the wearable device and a grip state of the body coupling component of the user is released or a set exercise time or an exercise session is terminated, it may be determined that the termination condition is satisfied. When the termination condition is satisfied, the operation of the wearable device may be terminated. When the termination condition is not satisfied, the wearable device may return to operation 820 and may perform the process of controlling the tension of the cable based on the position of the user's hand and the tension control model.

Through this process, the wearable device may enhance an exercise effect of the user and may decrease the risk of injury of the user through customized exercise posture guide and resistance control for various exercise types. In addition, the wearable device may effectively guide the user to perform an exercise with a proper exercise posture and may assist the user to perform the strength exercise with a proper posture.

Figure 9:
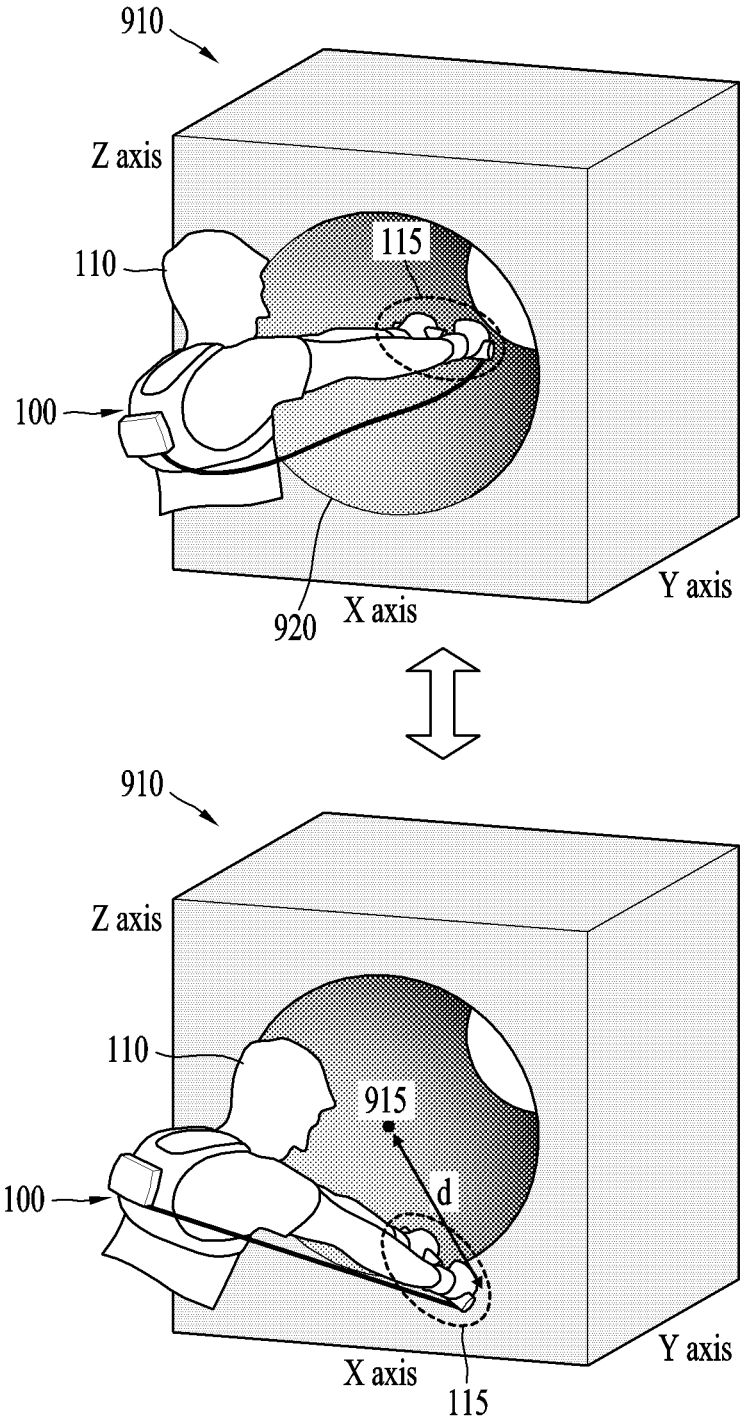
FIG. 9 is a diagram illustrating a change in a target tension value of a tension control model according to a position of a user's hand in an exercise posture guide mode according to an example embodiment.

FIG. 9 is a diagram illustrating a change in a target tension value of a tension control model according to a position of a user's hand in an exercise posture guide mode according to an example embodiment.

Referring to FIG. 9, a tension control model when the wearable device 100 operates in an exercise posture guide mode for bench press is represented as a 3D impedance map 910. The 3D impedance map 910 may represent a 3D distribution showing what intensity a target tension value needs to be determined depending on a position of a hand 115 of the user 110 in a surrounding space (e.g., a forward direction in which the user 110 views) of the user 110. When the user 110 is in an exercise posture of bench press while wearing the wearable device 100 and extends the hand 115 holding a body coupling component (e.g., the body coupling components 40 and 45 of FIG. 1A) of the wearable device 100 toward a target area 920 of the 3D impedance map 910, the wearable device 100 may apply a low tension value to a cable (e.g., the cables 30 and 35 of FIG. 1A) of the wearable device 100. Thereby, the user 110 may barely feel resistance or may feel little resistance by the wearable device 100 when performing the exercise posture.

In the 3D impedance map 910, the target area 920 may be set based on a target path of a tension control model corresponding to preferable exercise trajectory of the user's hand in the exercise type of bench press. In an example embodiment, as a distance between a position (corresponding to a position of the body coupling component of the wearable device 100) of the hand 115 of the user 110 and a target path of the tension control model set for guiding the exercise posture of bench press decreases, a parameter value for virtual stiffness and a parameter value for virtual damping of the tension control model may have small values, thereby, the user 110 may not feel resistance by the wearable device 100 or may feel little resistance and may easily perform the exercise posture of bench press. As the distance between the position of the hand 115 and the target path of the tension control model decreases, a distance function value of the tension control model may have a small value. Accordingly, the tension value applied to the cable of the wearable device 100 may decrease.

In an example embodiment, as the distance between the position of the hand 115 of the user 110 and the target path of the tension control model set for guiding the exercise posture of bench press increases, the parameter value for virtual stiffness and the parameter value for virtual damping of the tension control model may have great values, thereby, the user 110 may feel great resistance by the wearable device 100 and may feel difficulty in performing the exercise posture of bench press. As the distance between the position of the hand 115 and the target path of the tension control model increases, a distance function value of the tension control model may have a great value. Accordingly, the tension value applied to the cable of the wearable device 100 may increase. For example, as a distance d between the point of the hand 115 and a closest point 915 in the target path increases, the tension value applied to the cable may increase. When a great tension value is applied to the cable, the user 110 may be restricted in their motion as if pushing against a wall with the hand 115. Through the control of the wearable device 100, the wearable device 100 may guide the user 110 on a preferable exercise posture for the exercise type of bench press and may induce the user 110 to perform the preferable exercise posture.

Figure 10:
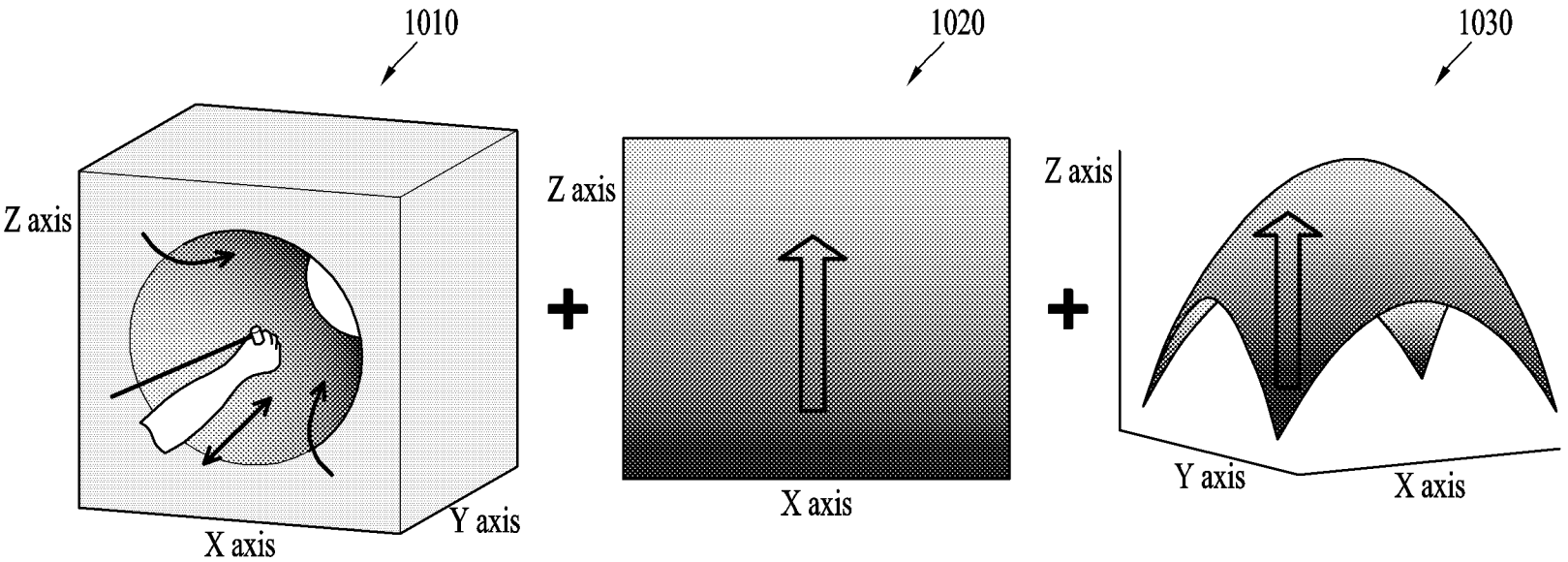
FIG. 10 is a diagram illustrating elements for determining a target tension value of a tension control model according to an example embodiment.

FIG. 10 is a diagram illustrating elements for determining a target tension value of a tension control model according to an example embodiment.

Referring to FIG. 10, among elements for determining a target tension value of a tension control model, a 3D impedance map 1010 representing virtual stiffness, a 3D impedance map 1020 representing virtual damping, and a 3D impedance map 1030 representing virtual inertia are illustrated. Based on at least one of the elements of virtual stiffness, virtual damping, and virtual inertia, a target tension value of the tension control model may be determined. The 3D impedance maps 1010, 1020, and 1030 may be 3D maps showing how parameter values with respect to virtual stiffness, virtual damping, and virtual inertia of the tension control model are defined in a 3D space, respectively. In an example embodiment, a distribution of at least one of parameter values for virtual stiffness, virtual damping, and virtual inertia in the 3D space may be defined. A parameter value in the 3D space may be determined with respect to all of the parameter value for virtual stiffness, the parameter value for virtual damping, and the parameter value for virtual inertia and a parameter value in the 3D space may be determined with respect to any one or any two thereof.

A characteristic of the tension applied to the cable of the wearable device may vary by the 3D impedance map 1010 with respect to virtual stiffness, the 3D impedance map 1020 with respect to virtual damping, and the 3D impedance map 1030 with respect to virtual inertia. For example, resistance similar to a rubber band may be generated through the 3D impedance map 1010 with respect to virtual stiffness, resistance like moving in water may be generated through the 3D impedance map 1020 with respect to virtual damping, and resistance of a barbell exercise by gravity may be generated through the 3D impedance map 1030 with respect to virtual inertia.

In an example embodiment, the target tension value defined through the 3D impedance map 1010 with respect to virtual stiffness, the 3D impedance map 1020 with respect to virtual damping, and the 3D impedance map 1030 with respect to virtual inertia may vary depending on a position of the user's hand. For example, in the 3D impedance map 1010 with respect to virtual stiffness, as the position of the user's hand moves away from the target path, a greater target tension value may be set and in the 3D impedance map 1020 with respect to virtual damping and the 3D impedance map 1030 with respect to virtual inertia, as the position of the user's hand raises up, a greater target tension value may be set.

Figure 11:
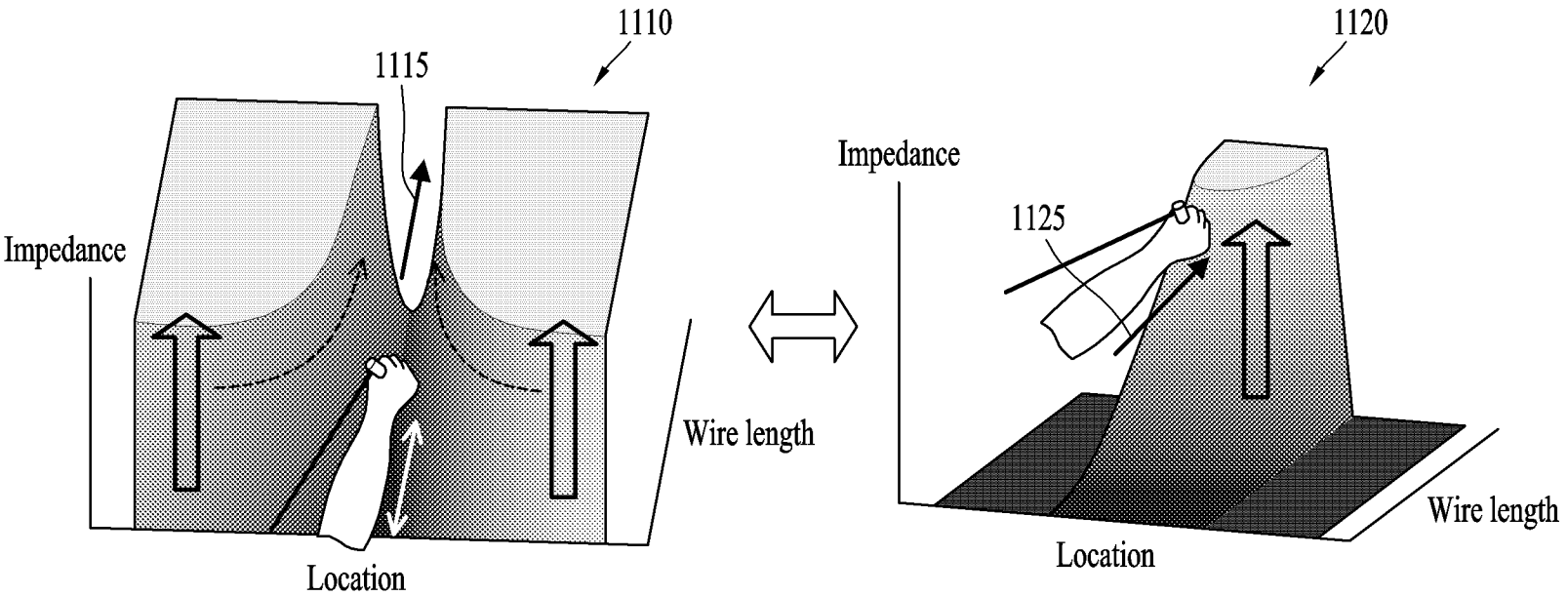
FIG. 11 is a diagram illustrating a change of a tension control model according to an operation mode of a wearable device according to an example embodiment.

FIG. 11 is a diagram illustrating a change of a tension control model according to an operation mode of a wearable device according to an example embodiment.

According to an example embodiment, even for the same exercise type (e.g., bench press), the tension control model may vary depending on an operation mode of the wearable device 100. In a tension control model 1110 used in an exercise posture guide mode for guiding an exercise posture, parameters may be determined to guide the user on an intended exercise posture. For example, the tension control model 1110 may have parameters causing the tension of a small value or "0" to be applied to the cable of the wearable device 100 with respect to a target path 1115 of the user's hand corresponding to the intended exercise posture of bench press and causing the tension of a great value to be applied to the cable as a distance from the target path 1115 increases. The wearable device 100 may generate the tension control model 1110 having low impedance in a target path based on the target path learned during a process of generating the tension control model 1110 and may guide the user on the intended exercise posture using the generated tension control model 1110.

A tension control model 1120 used in the strength exercise assistance mode for enhancing the strength may have parameter values set to provide resistance to the user with respect to the intended exercise posture. The wearable device 100 may generate the tension control model 1120 for the strength exercise assistance mode by increasing a tension value with respect to a target path learned during a process of generating the tension control model 1110. For example, the tension control model 1120 may have parameters causing the tension of a great value to be applied to the cable of the wearable device 100 with respect to a target path 1125 of the user's hand corresponding to the intended exercise posture of bench press. The tension control model 1120 may have parameters causing the tension of a small value or "0" to be applied to the cable with respect to a path that is different from the target path 1125. Through this, the user may feel great resistance for the exercise posture in the target path 1125 but may feel "0" or little resistance at a position other than the target path 1125. The wearable device 100 may reduce the risk of injury due to an inappropriate exercise posture by inducing the user to perform the strength exercise with a preferable exercise posture corresponding to the target path 1125 through the tension control model 1120. When exercise intensity of an exercise performed by the user is adjusted, the parameter of the tension control model 1120 may be changed. For example, when the exercise intensity increases, the parameter of the tension control model 1120 may be changed to apply higher tension to the cable of the wearable device 100 in the target path 1125. When the exercise intensity decreases, the parameter of the tension control model 1120 may be changed to apply lower tension to the cable of the wearable device 100 in the target path 1125.

Figure 12:
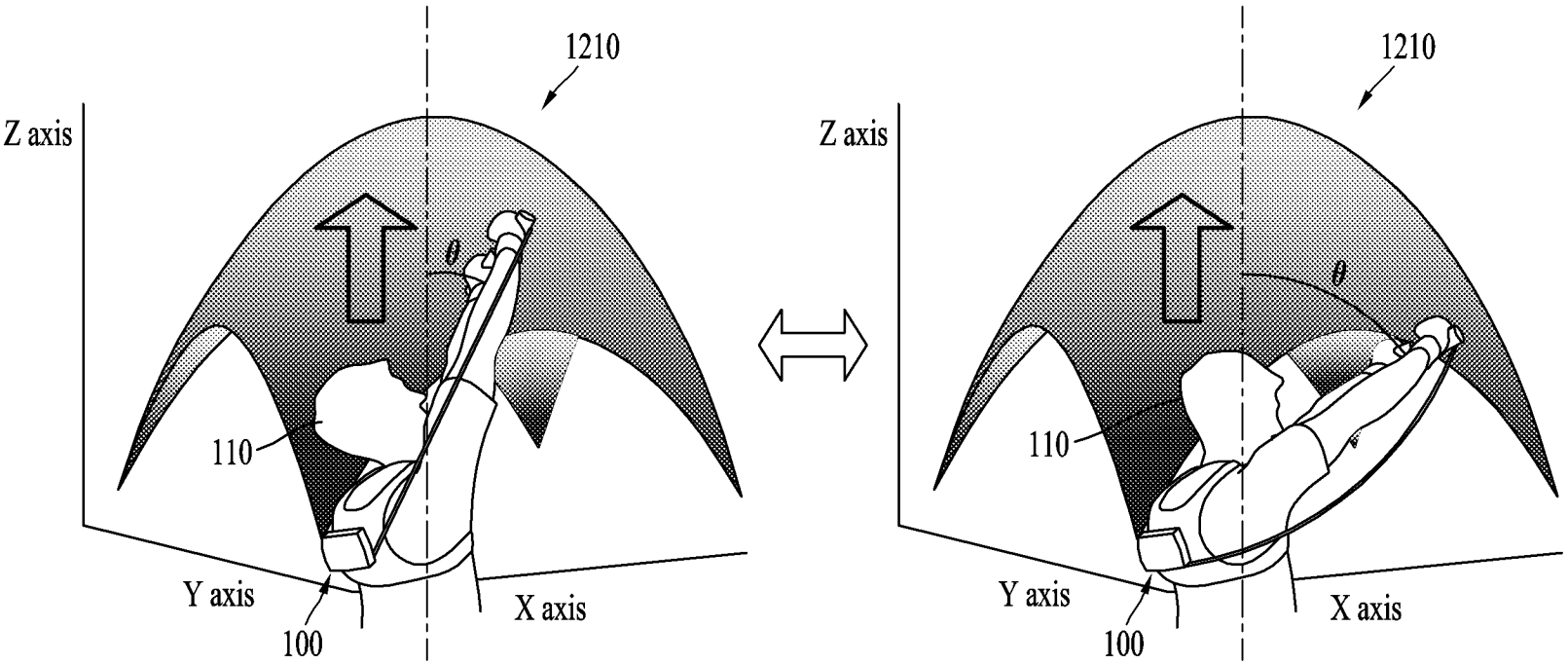
FIG. 12 is a diagram illustrating a tension control model in a shoulder press exercise and a change in a tension value according to a position of a user's hand according to an example embodiment.

FIG. 12 is a diagram illustrating a tension control model in a shoulder press exercise and a change in a tension value according to a position of a user's hand according to an example embodiment.

Referring to FIG. 12, a tension control model 1210 that is used when the wearable device 100 operates in a strength exercise assistance mode for an exercise type of shoulder press is illustrated. In the case of the exercise type of shoulder press, extending a hand (or an arm) of a user upward from a default position may be a preferable exercise posture. When the user 110 performs an exercise posture by moving the user's hand closer to the Z-axis direction, a parameter value representing virtual inertia of the tension control model 1210 may increase and the user 110 may feel resistance as if the user 110 performs a barbell exercise against the gravity through the wearable device 100. When the user 110 performs the exercise posture by moving the user's hand in a direction away from the Z-axis direction, the parameter value representing virtual inertia of the tension control model 1210 determining the tension applied to the cable of the wearable device 100 may decrease, thereby, small tension may be applied to the cable of the wearable device 100 and the resistance felt by the user 110 may decrease. For example, the parameter value representing virtual inertia of the tension control model 1210 may be proportional to a value of cos θ by an angle θ (between 0 and 90 degrees) formed by the position of the hand of the user 110 and the Z-axis direction corresponding to the target path.

Figure 13:
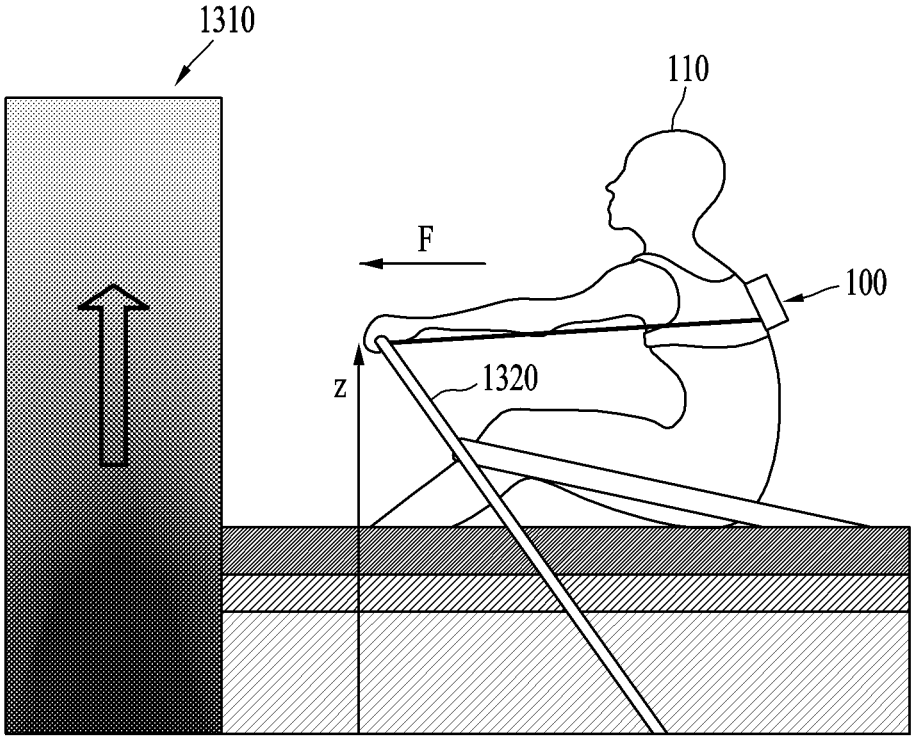
FIG. 13 is a diagram illustrating a tension control model in a rowing exercise and a change in a tension value according to a position of a user's hand according to an example embodiment.

FIG. 13 is a diagram illustrating a tension control model in a rowing exercise and a change in a tension value according to a position of a user's hand according to an example embodiment.

Referring to FIG. 13, the user 110 may wear the wearable device 100 and may perform a strength exercise through rowing exercise equipment 1320. A tension control model 1310 that is used when the wearable device 100 operates in a strength exercise assistance mode for an exercise type of rowing is illustrated. The exercise type of rowing may include an exercise posture of stretching a hand (or an arm) forward and pulling back at a height z. The wearable device 100 may provide resistance that is proportional to the speed at which the user 110 pushes an oar of the exercise equipment 1320 through the tension control model 1310.

In the tension control model 1310, an influence of a parameter value with respect to virtual damping Ca on a tension value of a cable may be significant. For example, the parameter value representing virtual damping of the tension control model 1310 may be proportional to the height z of the hand of the user 110. As a height value of the hand of the user 110 decreases, the parameter value with respect to virtual damping of the tension control model 1310 may decrease. In this case, the wearable device 100 may generate tension of a small value or "0" on the cable through the tension control model 1310 and the user 110 may feel little resistance as if the user 110 rows in the air. As the height value of the hand of the user 110 increases, the parameter value with respect to virtual damping of the tension control model 1310 may increase. In this case, the wearable device 100 may generate tension of a great value on the cable through the tension control model 1310 and the user 110 may feel resistance as if the user 110 rows in water.

According to an example embodiment, the wearable device 100 described herein may be modified and used to assist a leg exercise of the user. In this case, the wearable device 100 may be worn on the user and may assist a leg strength exercise or walking of the user.

Figure 14:
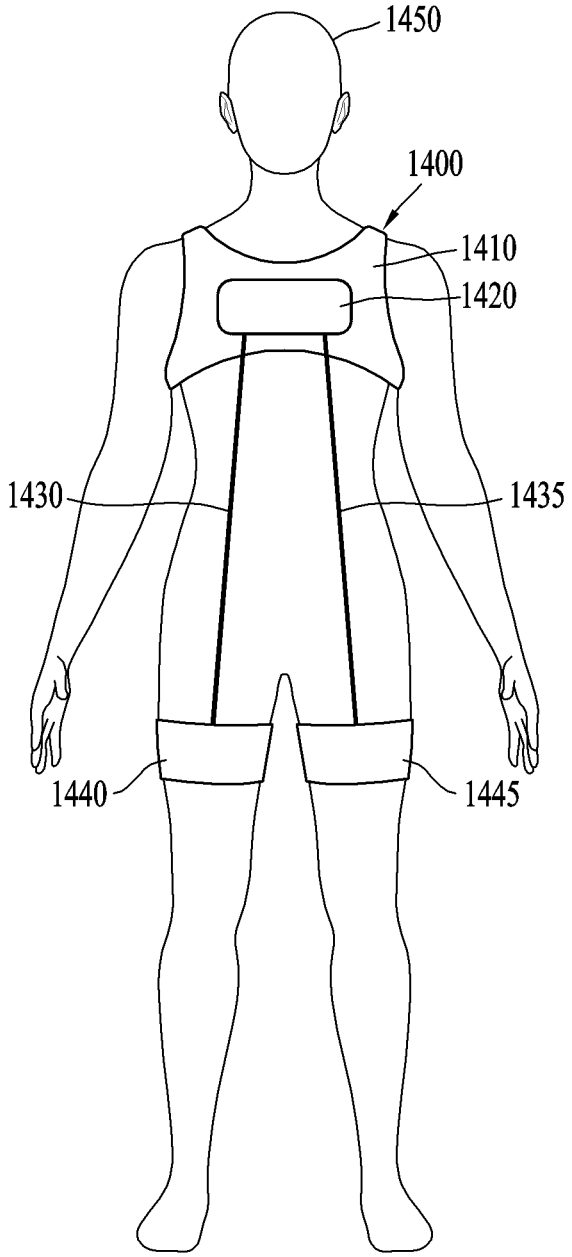
FIG. 14 is a diagram illustrating a wearable device for assisting a leg exercise according to an example embodiment.

FIG. 14 is a diagram illustrating a wearable device for assisting a leg exercise according to an example embodiment. Referring to FIG. 14, a wearable device 1400 according to an example embodiment may include a first wearing part 1410, a main body module 1420, cables 1430 and 1435 connected to an actuator of the main body module 1420, and body coupling components 1440 and 1445 connected to the cables 1430 and 1435 and connected or fixed to a body part (e.g., thighs or calves) of a user 1450. The body coupling components 1440 and 1445 may each have, for example, a shape of a band or a frame worn on the thigh of the user. The wearable device 1400 may further include a sensor (not shown) configured to measure a leg motion of the user 1450 and generate motion data corresponding to the leg motion. The description provided above may apply to descriptions other than the description provided below in relation to each component of the wearable device 1400.

The body module 1420 may include an actuator and at least one processor configured to control the actuator. The processor may estimate a position of a leg based on the motion data corresponding to the leg motion of the user 1450. The processor may determine a tension value to be applied to the cable at the leg position based on the leg position and a tension control model defined with respect to a surrounding space of the user 1450 and may control the actuator to generate the tension at the determined tension value on the cable. The processor may control the actuator to generate a target tension value of the tension control model determined by the leg position on the cable. The processor may determine the tension value by applying, to the tension control model, a distance between the leg position and a target path defined within the surrounding space of the user 1450, moving velocity at the leg position, and moving acceleration at the leg position.

The wearable device 1400 may assist walking of the user 1450 by controlling a tension value applied to the cable through the tension control model when the user 1450 walks or may assist a strength exercise by providing resistance through the cable when the user 1450 performs a lower body exercise, such as squats or lunges. In addition, when the user 1450 feels discomfort in walking due to a disability in one leg of the user 1450, the wearable device 1400 may assist a disabled leg for walking and may provide resistance to a normal leg to balance the gait of the user 1450.

Figure 15:
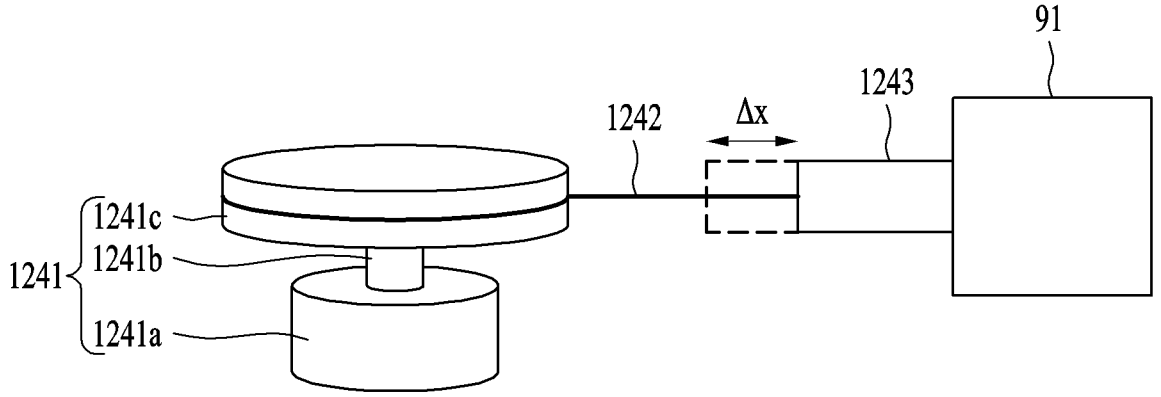
FIG. 15 is a diagram illustrating tension control of a cable by an actuator according to an example embodiment.

FIG. 15 is a diagram illustrating tension control of a cable by an actuator according to an example embodiment.

Referring to FIG. 15, an actuator of a wearable device (e.g., the wearable device 100 of FIG. 1A or the wearable device 1400 of FIG. 14) may include a motor 1241. The motor 1241 may include a motor body 1241*a* configured to generate torque (or power), a motor shaft 1241*b* rotating by the torque of the motor body 1241*a*, and an output end 1241*c* connected to the motor shaft 1241*b*. An inelastic cable 1242 may be fixed to the output end 1241*c* and the inelastic cable 1242 may be wound or unwound from the output end 1241*c* in a rotation direction of the output end 1241*c*. An elastic cable 1243 may be connected to one end of the inelastic cable 1242. One end of the elastic cable 1243 may be connected to the inelastic cable 1242 and the other end may be connected to a body coupling component 91 (e.g., the body coupling components 40 and 45 of FIG. 1A and the body coupling components 1440 and 1445 of FIG. 14). The cable (e.g., the cables 30 and 35 of FIG. 3 and the cables 1430 and 1435 of FIG. 14) described with reference to the above drawings may have a structure in which the inelastic cable 1242 and the elastic cable 1243 are connected to each other. The elastic cable 1243 may be deformed by the tension of the inelastic cable 1242. The drawing schematically shows that the length of the elastic cable 1243 may change by x. The wearable device may control the tension applied to the inelastic cable 1242 and the elastic cable 1243 by controlling the rotation of the motor 1241. For example, when a position of the body coupling component 91 is fixed and the inelastic cable 1242 is pulled by rotating the output end 1241*c* in one rotation direction, the tension applied to the inelastic cable 1242 and the elastic cable 1243 may increase and when the inelastic cable 1242 is unwound by rotating the output end 1241*c* in the other rotation direction, the tension applied to the inelastic cable 1242 and the elastic cable 1243 may decrease.

According to an example embodiment, the wearable device 100 may include the actuators 440 and 445, a sensor configured to measure a motion of a user's hand and generate motion data corresponding to the motion of the user's hand, at least one processor 510 configured to control the actuators 440 and 445, the cables 30 and 35 connected to the actuators 440 and 445, and the body coupling components 40 and 45 connected to the cables 30 and 35 and connected or fixed to a body part of the user. The at least one processor 510 may estimate a position of the user's hand based on the motion data corresponding to the motion of the user's hand, may determine a tension value to be applied to the cables 30 and 35 at the position of the user's hand based on the position of the user's hand and a tension control model defined with respect to a surrounding space of the user, and may control the actuators 440 and 445 to generate tension at the determined tension value on the cables 30 and 35.

In an example embodiment, the tension control model may be a model that provides a target tension value based on the position of the user's hand in the surrounding space of the user. The tension control model may determine a target tension value based on at least one of a parameter value related to the inertial characteristic, a parameter value related to the damping characteristic, and a parameter value related to the stiffness characteristic. At least one of the parameter value related to the inertial characteristic, the parameter value related to the damping characteristic, and the parameter value related to the stiffness characteristic may vary depending on the position of the user's hand. The tension control model may comprise processing circuitry.

In an example embodiment, the at least one processor 510 may control the actuators 440 and 445 to generate a target tension value of the tension control model determined by the position of the user's hand on the cables 30 and 35.

In an example embodiment, the at least one processor 510 may determine a tension value of the cables 30 and 35 by applying, to the tension control model, a distance between a target path defined within the surrounding space of the user and the position of the user's hand, moving velocity at the position of the user's hand, and motion acceleration at the position of the user's hand. The tension value applied to the target path and the tension value applied to the surrounding of the target path may be differently determined.

In an example embodiment, the at least one processor 510 may determine a parameter value of a parameter of the tension control model based on whether an operation mode of the wearable device 100 is an exercise posture guide mode or a strength exercise assistance mode. In the exercise posture guide mode, the at least one processor 510 may determine a tension value to be applied to the cables 30 and 35 at the position of the user's hand by using the tension control model in which a tension value applied to the surrounding of the target path defined within the surrounding space of the user is set to be greater than a tension value applied to the target path. In the strength exercise assistance mode, the at least one processor 510 may determine a tension value to be applied to the cables 30 and 35 at the position of the user's hand by using the tension control model in which a tension value applied to the target path is set to be greater than a tension value applied to the surrounding of the target path. In the strength exercise assistance mode, a parameter value of the tension control model may vary depending on set exercise intensity.

In an example embodiment, the tension control model may be generated through a training process including setting an exercise type, obtaining guide motion data for the exercise of the set exercise type, and determining parameters of the tension control model based on the obtained guide motion data. The training process of the tension control model may include a process of determining a target path in a 3D space with respect to a motion of the user based on the guide motion data and a process of determining parameters of the tension control model for determining a tension value in the 3D space based on the determined target path. The guide motion data may be motion data obtained by a motion of the user wearing the wearable device during the training process of the tension control model or motion data received from another device.

According to an example embodiment, the wearable device 1400 may include an actuator, a sensor configured to measure a motion of a user's leg and generate motion data corresponding to the motion of the user's leg, at least one processor configured to control the actuator, the cables 1430 and 1435 connected to the actuator, and the body coupling components 1440 and 1445 connected to the cables 1430 and 1435 and connected or fixed to a body part of the user. The at least one processor may estimate a position of the user's leg based on the motion data corresponding to the motion of the user's leg, may determine a tension value to be applied to the cables 1430 and 1435 at the position of the user's leg based on the position of the user's leg and a tension control model defined with respect to a surrounding space of the user, and may control the actuator to generate tension at the determined tension value on the cables 1430 and 1435. The at least one processor may control the actuator to generate a target tension value of the tension control model on the cables 1430 and 1435 determined by the position of the user's leg. The at least one processor may determine a tension value by applying, to the tension control model, a distance between a target path defined within the surrounding space of the user and the position of the user's leg, moving velocity at the position of the user's leg, and motion acceleration at the position of the user's leg.

According to an example embodiment, an exercise assistance method by the wearable device 100 including the actuators 440 and 445, a sensor, the cables 30 and 35 connected to the actuators 440 and 445, and the body coupling components 40 and 45 connected to the cables 30 and 35 and connected or fixed to a body part of the user may include an operation of obtaining motion data corresponding to a motion of a user's hand, operation 820 of estimating a position of the user's hand based on the motion data, operation 830 of determining a tension value to be applied to the cables 30 and 35 at the position of the user's hand based on the position of the user's hand and a tension control model defined with respect to a surrounding space of the user, and operation 840 of controlling the actuators 440 and 445 to generate tension at the determined tension value on the cables 30 and 35. Operation 840 of controlling the actuator may include operation of controlling the actuators 440 and 445 to generate a target tension value of the tension control model determined by the position of the user's hand on the cables 30 and 35. Operation 830 of determining the tension value may include operation of determining the tension value by applying, to the tension control model, a distance between the position of the user's hand and a target path defined within the surrounding space of the user, moving velocity at the position of the user's hand, and moving acceleration at the position of the user's hand.

It should be appreciated that various embodiments of the present disclosure and the terms used therein are not intended to limit the technological features set forth herein to particular embodiments and include various changes, equivalents, or replacements for a corresponding embodiment. In connection with the description of the drawings, like reference numerals may be used for similar or related components. It is to be understood that a singular form of a noun corresponding to an item may include one or more of the things, unless the relevant context clearly indicates otherwise. As used herein, "A or B," "at least one of A and B," "at least one of A or B," "A, B or C," "at least one of A, B and C," and "at least one of A, B, or C," may include any one of the items listed together in the corresponding one of the phrases, or all possible combinations thereof. Terms such as "1st" and "2nd," or "first" and "second" may be used to simply distinguish a corresponding component from other components, and do not limit the components in other aspects (e.g., importance or order). It is to be understood that if an element (e.g., a first element) is referred to, with or without the term "operatively" or "communicatively," as "coupled with," "coupled to," "connected with," or "connected to" another element (e.g., a second element), the element may be coupled with the other element directly (e.g., by wire), wirelessly, or via at least a third element(s).

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC). Thus, each "module" herein may comprise circuitry.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, or computer storage medium or device capable of providing instructions or data to or being interpreted by the processing device. The software also may be distributed over network-coupled computer systems so that the software is stored and executed in a distributed fashion. The software and data may be stored by one or more non-transitory computer-readable recording mediums. Embodiments as set forth herein may be implemented as software including one or more instructions that are stored in a storage medium that is readable by a machine. For example, a processor of the machine may invoke at least one of the one or more instructions stored in the storage medium and execute it. This allows the machine to be operated to perform at least one function according to the at least one instruction invoked. The one or more instructions may include code generated by a compiler or code executable by an interpreter. The machine-readable storage medium may be provided in the form of a non-transitory storage medium. Here, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an example embodiment, a method according to embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to embodiments, each component (e.g., a module or a program) of the above-described components may include a single entity or multiple entities, and some of the multiple entities may be separately disposed in different components. According to embodiments, one or more of the above-described components may be omitted, or one or more other components may be added. Alternatively or additionally, a plurality of components (e.g., modules or programs) may be integrated into a single component. In such a case, according to embodiments, the integrated component may still perform one or more functions of each of the plurality of components in the same or similar manner as they are performed by a corresponding one of the plurality of components before the integration. According to embodiments, operations performed by the module, the program, or another component may be carried out sequentially, in parallel, repeatedly, or heuristically, or one or more of the operations may be executed in a different order or omitted, or one or more other operations may be added. While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A wearable device, comprising:

an actuator comprising a motor and/or circuitry;

a sensor configured to measure a motion of a hand of a user and generate motion data based on the motion of the hand of the user;

at least one processor comprising processing circuitry;

a cable connected to the actuator; and a body coupling component connected to the cable, and configured to be gripped by, held by, connected to, and/or fixed to a body part of the user, wherein the at least one processor is individually and/or collectively configured to:

estimate a position of the hand of the user based on the motion data, determine a tension value to be applied to the cable at the position of the hand of the user based on the position of the hand of the user and a tension control model defined with respect to a surrounding space of the user, and control the actuator to generate tension at least at the determined tension value on the cable.

2. The wearable device of claim 1, wherein the tension control model comprises processing circuitry and is configured to provide a target tension value based on the position of the hand of the user in the surrounding space of the user.

3. The wearable device of claim 2, wherein the tension control model is configured to determine the target tension value based on at least one of a parameter value related to an inertial characteristic, a parameter value related to a damping characteristic, and a parameter value related to a stiffness characteristic.

4. The wearable device of claim 3, wherein the at least one of the parameter value related to the inertial characteristic, the parameter value related to the damping characteristic, and the parameter value related to the stiffness characteristic varies depending on the position of the hand of the user.

5. The wearable device of claim 1, wherein the at least one processor is configured to control the actuator to generate, on the cable, a target tension value of the tension control model based on the position of the hand of the user.

6. The wearable device of claim 1, wherein the at least one processor is configured to determine the tension value at least by applying, to the tension control model, a distance between the position of the hand of the user and a target path defined within the surrounding space of the user, a moving velocity at the position of the hand of the user, and a moving acceleration at the position of the hand of the user.

7. The wearable device of claim 6, wherein the tension value applied to the target path is determined differently from a tension value applied to a surrounding of the target path.

8. The wearable device of claim 1, wherein the at least one processor is configured to determine a parameter value of a parameter of the tension control model based on whether an operation mode of the wearable device is an exercise posture guide mode or a strength exercise assistance mode.

9. The wearable device of claim 8, wherein the at least one processor is configured to:

in the exercise posture guide mode, determine a tension value to be applied to the cable at the position of the hand of the user at least by using the tension control model in which a tension value applied to a surrounding of a target path defined within the surrounding space of the user is set to be greater than a tension value applied to the target path, and in the strength exercise assistance mode, determine a tension value to be applied to the cable at the position of the hand of the user at least by using the tension control model in which a tension value applied to the target path is set to be greater than a tension value applied to the surrounding of the target path.

10. The wearable device of claim 8, wherein, in the strength exercise assistance mode, a parameter value of the tension control model varies depending on set exercise intensity.

11. The wearable device of claim 1, wherein the tension control model is generated through a training process comprising setting an exercise type, obtaining guide motion data for an exercise of the set exercise type, and determining parameters of the tension control model based on the obtained guide motion data.

12. The wearable device of claim 11, wherein the training process of the tension control model comprises determining a target path in a three-dimensional (3D) space with respect to a motion of the user based on the guide motion data and determining parameters of the tension control model for determining a tension value in the 3D space based on the determined target path.

13. The wearable device of claim 11, wherein the guide motion data is motion data obtained by a motion of the user wearing the wearable device during the training process of the tension control model or motion data received from another device.

14. A wearable device, comprising:

an actuator comprising a motor and/or circuitry;

a sensor configured to measure a motion of a leg of a user and generate motion data based on the motion of the leg of the user;

at least one processor comprising processing circuitry;

a cable connected to the actuator; and a body coupling component connected to the cable, and configured to contact, be connected to, and/or be fixed to, a body part of the user, wherein the at least one processor is individually and/or collectively configured to:

estimate a position of at least part of the leg based on the motion data, determine a tension value to be applied to the cable at the position of the at least part of the leg based on the position of the at least part of the leg of the user and a tension control model, and control the actuator to generate tension at the determined tension value on the cable.

15. The wearable device of claim 14, wherein the at least one processor is configured to control the actuator to generate, on the cable, a target tension value of the tension control model determined by the position of the at least part of the leg of the user.

16. The wearable device of claim 14, wherein the at least one processor is configured to determine the tension value at least by applying, to the tension control model, a distance between the position of the at least part of the leg of the user and a target path defined within a surrounding space of the user, a moving velocity at the position of the at least part of the leg of the user, and a moving acceleration at the position of the at least part of the leg of the user.

17. An exercise assistance method by a wearable device comprising an actuator, a sensor, a cable connected to the actuator, and a body coupling component connected to the cable and configured to be held by, gripped by, contacted by, connected to, and/or fixed to a body part of a user, the method comprising:

obtaining motion data corresponding to a motion of a hand of the user by using the sensor;

estimating a position of the hand of the user based on the motion data;

determining a tension value to be applied to the cable at the position of the hand of the user based on the position of the hand of the user and a tension control model; and controlling the actuator to generate tension at the determined tension value on the cable.

18. The method of claim 17, wherein the controlling of the actuator comprises controlling the actuator to generate, on the cable, a target tension value of the tension control model determined by the position of the hand of the user.

19. The method of claim 17, wherein the determining of the tension value comprises determining the tension value at least by applying, to the tension control model, a distance between the position of the hand of the user and a target path defined within a surrounding space of the user, a moving velocity at the position of the hand of the user, and a moving acceleration at the position of the hand of the user.

20. A non-transitory computer-readable storage medium storing instructions that, when executed by a processor, cause the processor to perform the method of claim 17.

* * * * *